US007982144B2

(12) United States Patent
Kiryu et al.

(10) Patent No.: US 7,982,144 B2
(45) Date of Patent: Jul. 19, 2011

(54) INSERTING CONNECTOR, RECEIVING CONNECTOR, AND CONNECTOR UNIT

(75) Inventors: Koichi Kiryu, Shimotakai-gun (JP); Takashi Yuba, Shinagawa (JP); Seung Seok Beak, Shinagawa (JP); Hideo Miyazawa, Shinagawa (JP); Haruo Mochizuki, Shinagawa (JP); Keiichi Hirose, Minato (JP); Tomonori Iino, Minato (JP)

(73) Assignees: Fujitsu Component Limited, Tokyo (JP); NTT Facilities, Inc., Tokyo (JP)

( * ) Notice: Subject to any disclaimer, the term of this patent is extended or adjusted under 35 U.S.C. 154(b) by 330 days.

(21) Appl. No.: 12/420,106

(22) Filed: Apr. 8, 2009

(65) Prior Publication Data

US 2010/0029110 A1 Feb. 4, 2010

(30) Foreign Application Priority Data

Jul. 30, 2008 (JP) ..... 2008-196922
Sep. 29, 2008 (JP) ..... 2008-251497

(51) Int. Cl.
*H01H 9/00* (2006.01)

(52) U.S. Cl. ..... 200/51 R; 200/51.09; 200/51.11

(58) Field of Classification Search ..... 200/51 R, 200/51.09, 51.11, 51.12
See application file for complete search history.

(56) References Cited

U.S. PATENT DOCUMENTS

| | | | | |
|---|---|---|---|---|
| 4,224,484 | A * | 9/1980 | Haas et al. | 200/38 FB |
| 4,356,368 | A * | 10/1982 | Osika | 200/307 |
| 4,472,611 | A | 9/1984 | Schoch | |
| 4,678,254 | A | 7/1987 | Le Magourou | |
| 5,734,206 | A * | 3/1998 | Keizer et al. | 307/116 |
| 6,590,169 | B2 * | 7/2003 | Martinez | 200/17 R |
| 7,504,600 | B2 * | 3/2009 | Hallet et al. | 200/61.54 |
| 7,723,630 | B1 * | 5/2010 | Jordan et al. | 200/334 |
| 7,754,985 | B2 * | 7/2010 | Gordon et al. | 200/1 R |
| 2005/0242770 | A1 | 11/2005 | Britto | |

FOREIGN PATENT DOCUMENTS

| | | |
|---|---|---|
| GB | 437 309 A | 10/1935 |
| JP | 05-082208 | 4/1993 |
| JP | 2003-031301 | 1/2003 |
| WO | WO 2007/072581 A | 6/2007 |

OTHER PUBLICATIONS

Extended European Search Report , Aug. 7, 2009.

* cited by examiner

*Primary Examiner* — Gary F. Paumen

(74) *Attorney, Agent, or Firm* — IPUSA, PLLC

(57) ABSTRACT

An inserting connector connected to a receiving connector, the receiving connector being configured to electrically connect an electric power source and an electric apparatus receiving an electric power supply from the electric power source, the inserting connector being connected to the electric apparatus, the inserting connector includes two electric power plug terminals made of a conductor, the conductor being configured to receive the electric power supply; and a control plug terminal configured to be extended and retracted in an inserting direction.

28 Claims, 18 Drawing Sheets

INSERTING CONNECTOR, RECEIVING CONNECTOR, AND CONNECTOR UNIT

CROSS-REFERENCE TO RELATED APPLICATIONS

This patent application is based upon and claims the benefit of priority of Japanese Patent Application No. 2008-196922 filed on Jul. 30, 2008 and Japanese Patent Application No. 2008-251497 filed on Sep. 29, 2008 the entire contents of which are incorporated herein by reference.

BACKGROUND OF THE INVENTION

1. Field of the Invention

The present invention generally relates to inserting connectors, receiving connectors, and connector units. More specifically, the present invention relates to an inserting connector, a receiving connector, and a connector unit which are used for supplying electric power.

2. Description of the Related Art

It is normal practice that an electric apparatus is operated by receiving a supply of electric power from an electric power source. When the electric apparatus receives the supply of the electric power from the electric power source, normally the electric power is supplied from the electric power source to the electric apparatus via a connector unit.

As described in Japanese Laid-Open Patent Application Publication No. 5-82208 and Japanese Laid-Open Patent Application Publication No. 2003-31301, in such a connector unit, a convex-shaped inserting connector and a concave-shaped receiving connector are engaged with each other for electric connection.

On the other hand, as one measure for global warming or the like, even in electric power transmission in a local area, supplying high voltage and direct current electric power has been suggested whereby electric power loss in a voltage transformer or by electric power transmission can be made low and a cable is not required to be thick. In particular, in an information apparatus such as a server, such an electric power supply is desirable because a large amount of electric power is consumed.

If the voltage is high, the electric power supplied to the electric apparatus may influence a human body or operations of electronic components.

In a case where the high voltage electric power is used for the information apparatus such as the server, when the apparatus is installed or at the time of maintenance, operations are performed by humans. Therefore, it is necessary to use, as a connector unit for making electric connection, one different from a connector unit used for a conventional alternating current commercial electric power source.

SUMMARY OF THE INVENTION

Accordingly, embodiments of the present invention may provide a novel and useful inserting connector, receiving connector, and connector unit solving one or more of the problems discussed above.

More specifically, the embodiments of the present invention may provide an inserting connector, a receiving connector, and a connector unit whereby high voltage electric power can be safely supplied.

Another aspect of the present invention may be to provide an inserting connector connected to a receiving connector, the receiving connector being configured to electrically connect an electric power source and an electric apparatus receiving an electric power supply from the electric power source, the inserting connector being connected to the electric apparatus, the inserting connector comprising:

two electric power plug terminals made of a conductor, the conductor being configured to receive the electric power supply; and a control plug terminal configured to be extended and retracted in an inserting direction;

wherein the receiving connector is connected to the electric power source;

the receiving connector includes two electric power jack terminals corresponding to the electric power plug terminals; and a control jack terminal corresponding to the control plug terminal;

the control jack terminal includes two control switches connected to the two electric power jack terminals;

the electric power source is configured to supply electric power from the electric power jack terminals via the two control switches; and contacts of the two control switches are connected by extending the control plug terminal in the control jack terminal in the inserting direction in a state where two electric power plug terminals and the two electric power jack terminals are engaged with each other, so that the electric power is supplied to the electronic apparatus.

Another aspect of the present invention may be to provide a receiving connector connected to an inserting connector, the inserting connector being configured to electrically connect an electric power source and an electric apparatus receiving an electric power supply from the electric power source, the inserting connector being connected to the electric apparatus, the inserting connector including two electric power plug terminals made of a conductor, the conductor being configured to receive the electric power supply; and a control plug terminal configured to be extended and retracted in an inserting direction;

the receiving connector being connected to the electric power source, the receiving connector including:

two electric power jack terminals corresponding to the electric power plug terminals; and a control jack terminal corresponding to the control plug terminal;

wherein the control jack terminal includes two control switches connected to the two electric power jack terminals;

the electric power source is configured to supply electric power from the electric power jack terminals via the two control switches; and contacts of the two control switches are connected by extending the control plug terminal in the control jack terminal in the inserting direction in a state where two electric power plug terminals and the two electric power jack terminals are engaged with each other, so that the electric power is supplied to the electronic apparatus.

Another aspect of the present invention may be to provide a connector unit configured to electrically connect an electric power source and an electric apparatus receiving an electric power supply from the electric power source, the connector unit including:

an inserting connector connected to the electronic apparatus; and a receiving connector connected to the electric power source;

wherein the inserting connector includes two electric power plug terminals made of a conductor, the conductor being configured to receive the electric power supply; and a control plug terminal configured to be extended and retracted in an inserting direction;

the receiving connector includes two electric power jack terminals corresponding to the electric power plug terminals; and a control jack terminal corresponding to the control plug terminal;

the control jack terminal includes two control switches connected to the two electric power jack terminals;

the electric power source is configured to supply electric power from the electric power jack terminals via the two control switches; and contacts of the two control switches are connected by extending the control plug terminal in the control jack terminal in the inserting direction in a state where two electric power plug terminals and the two electric power jack terminals are engaged with each other, so that the electric power is supplied to the electronic apparatus.

DETAILED DESCRIPTION OF THE PREFERRED EMBODIMENTS

A description is given below, with reference to the FIG. 1 through FIG. 18 of embodiments of the present invention.

First Embodiment

An inserting connector, a receiving connector and a connector unit of a first embodiment of the present invention are discussed.

(Structures of Inserting Connector, Receiving Connector and Connector Unit)

Figure 1:
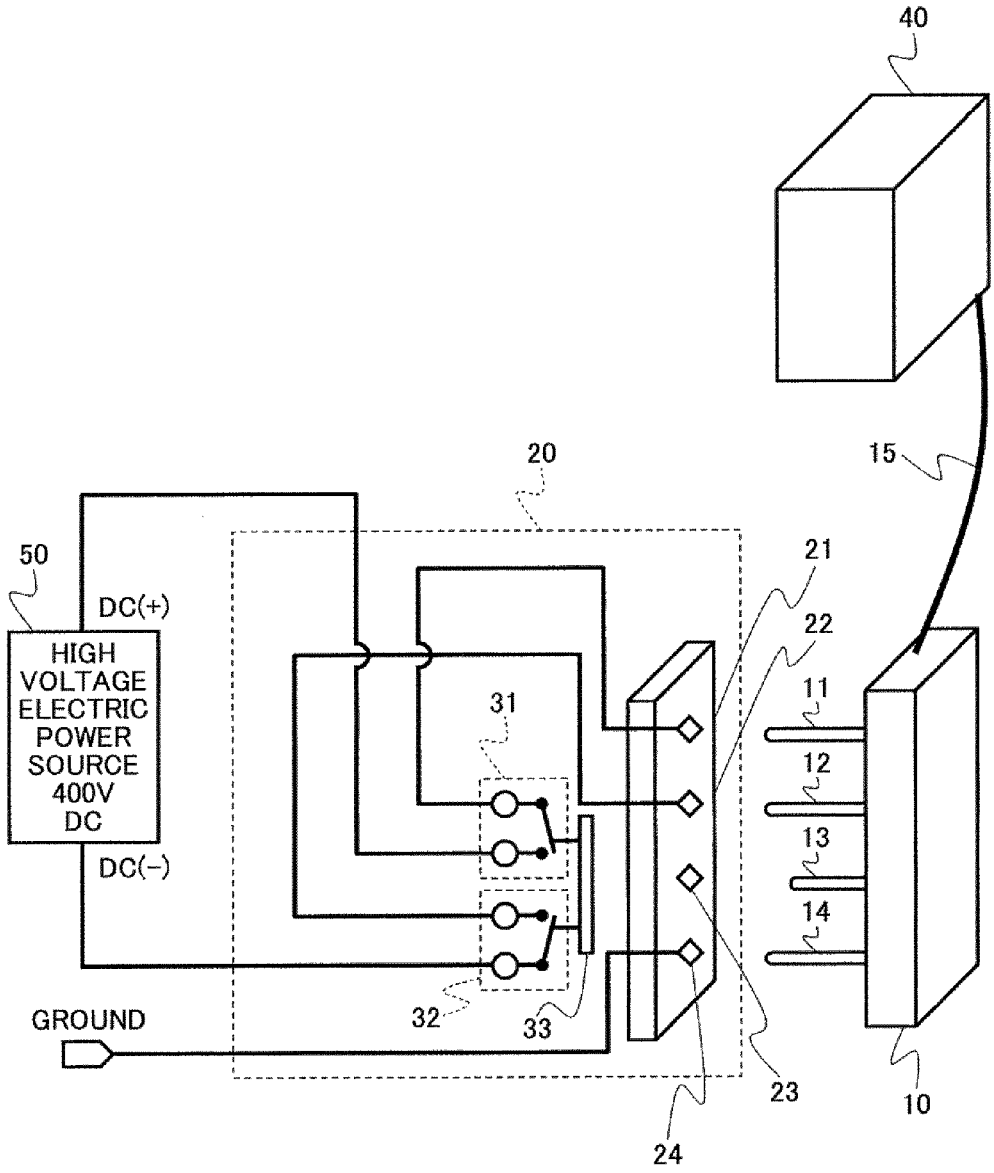
FIG. 1 is a structural diagram of a connector unit of a first embodiment of the present invention.

Structures of the inserting connector, the receiving connector and the connector unit of the first embodiment of the present invention are shown in FIG. 1.

The connector unit of the first embodiment of the present invention includes an inserting connector 10 and a receiving connector 20.

The inserting connector 10 is connected to an information apparatus 40 such as a server. The inserting connector 10 includes two electric power plug terminals 11 and 12, a control plug terminal 13, and a ground plug terminal 14. The control plug terminal 13 can be retracted in an inserting direction of the inserting connector 10.

On the other hand, the receiving connector 20 is connected to a high voltage electric power source 50 configured to supply the electric power. The receiving connector 20 includes electric power jack terminals 21 and 22 corresponding to the electric power plug terminals 11 and 12, a control jack terminal 23 corresponding to the control plug terminal 13, and a ground jack terminal 24 corresponding to the ground plug terminal 14.

In addition, the receiving connector 20 includes two control switches 31 and 32.

The control switches 31 and 32 include plate-shaped switches or the like. By pushing the control switches 31 and 32, their contacts come in contact and electric current flows. In this example, an insulation plate spring 33 is right above the control switches 31 and 32.

One end of the control switch 31 is connected to a positive output of the high voltage electric power source 50. Another end of the control switch 31 is connected to the electric power jack terminal 21. On the other hand, one end of the control switch 32 is connected to a negative output of the high voltage electric power source 50. Another end of the control switch 32 is connected to the electric power jack terminal 22.

In the two control switches 31 and 32, the contacts of the two control switches 31 and 32 are connected via the insulation plate spring 33 by extending the control plug terminal 13 of the inserting connector 10 in the inserting direction in a state where the inserting connector 10 and the receiving connector 20 are engaged with each other.

Thus, by connecting the contacts of the control switches 31 and 32, electric power is supplied to the electric power jack terminals 21 and 22 in the receiving connector 20. In addition, the electric power is supplied to the information apparatus 40 such as a server via the electric power plug terminals 11 and 12 of the inserting connector 10.

Thus, in the connector unit of the embodiment of the present invention, the control switches 31 and 32 are connected to the electric power jack terminals 21 and 22. In a case of direct current electric power of a high voltage higher than 48 V, more specifically, a high voltage equal to or higher than 200 V, there may be danger to the human body due to the contact. Accordingly, by connecting the control switches 31 and 32 to the electric power jack terminals 21 and 22, the supply of the electric power from the electric power jack terminals 21 and 22 is controlled so that safety is further improved.

In the embodiment of the present invention, the control jack terminal 23 is not limited to having a structure engaging with the control plug terminal 13 in a state where the control plug terminal 13 is extended. A structure of the control jack terminal 23 may be where a control switch or the like on and off controlled based on a dynamic force due to extension and retraction of the control plug terminal 13 is included inside.

(Structure of Connector Unit)

Next, a structure and a connecting method of a connector of the embodiment of the present invention are discussed with reference to FIG. 2 through FIG. 5.

Figure 2:
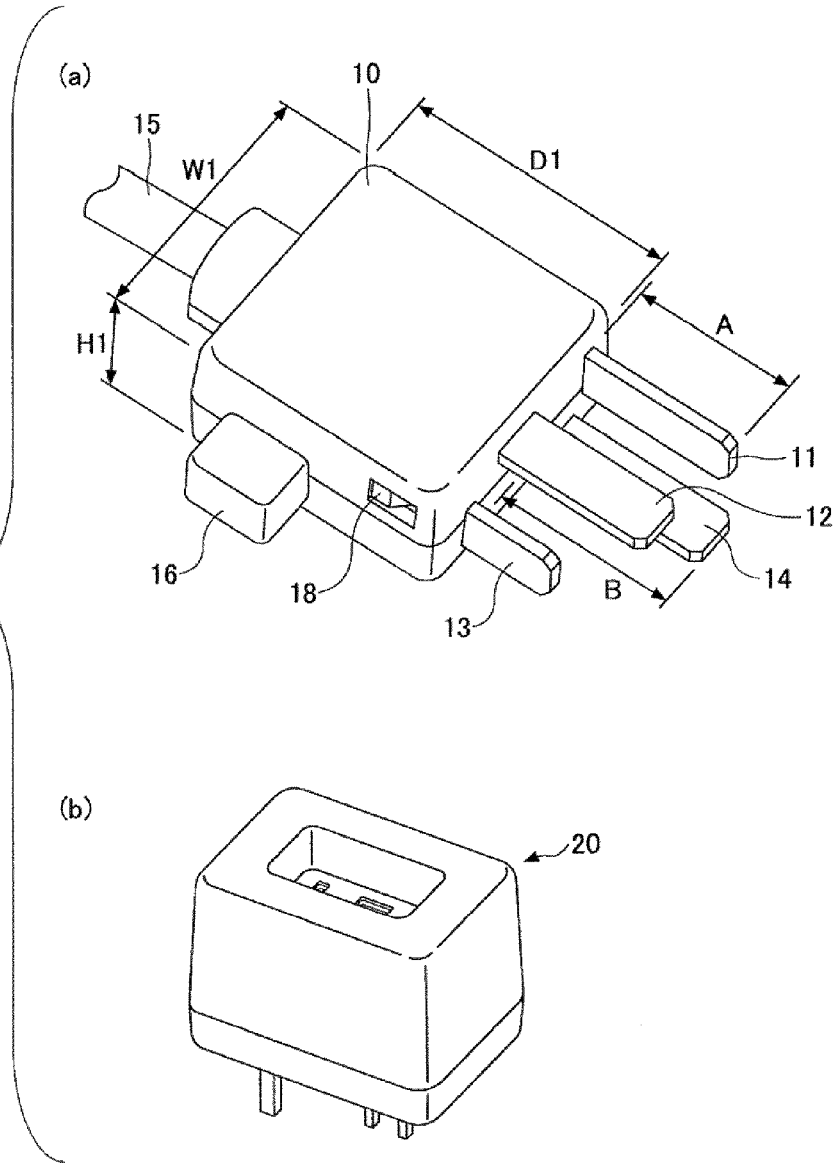
FIG. 2 is a perspective view of the connector unit of the first embodiment of the present invention.

FIG. 2(*a*) is a perspective view of the inserting connector 10 of the embodiment of the present invention. FIG. 2(*b*) is a perspective view of a main body of the receiving connector 20 of the embodiment of the present invention.

Figure 3:
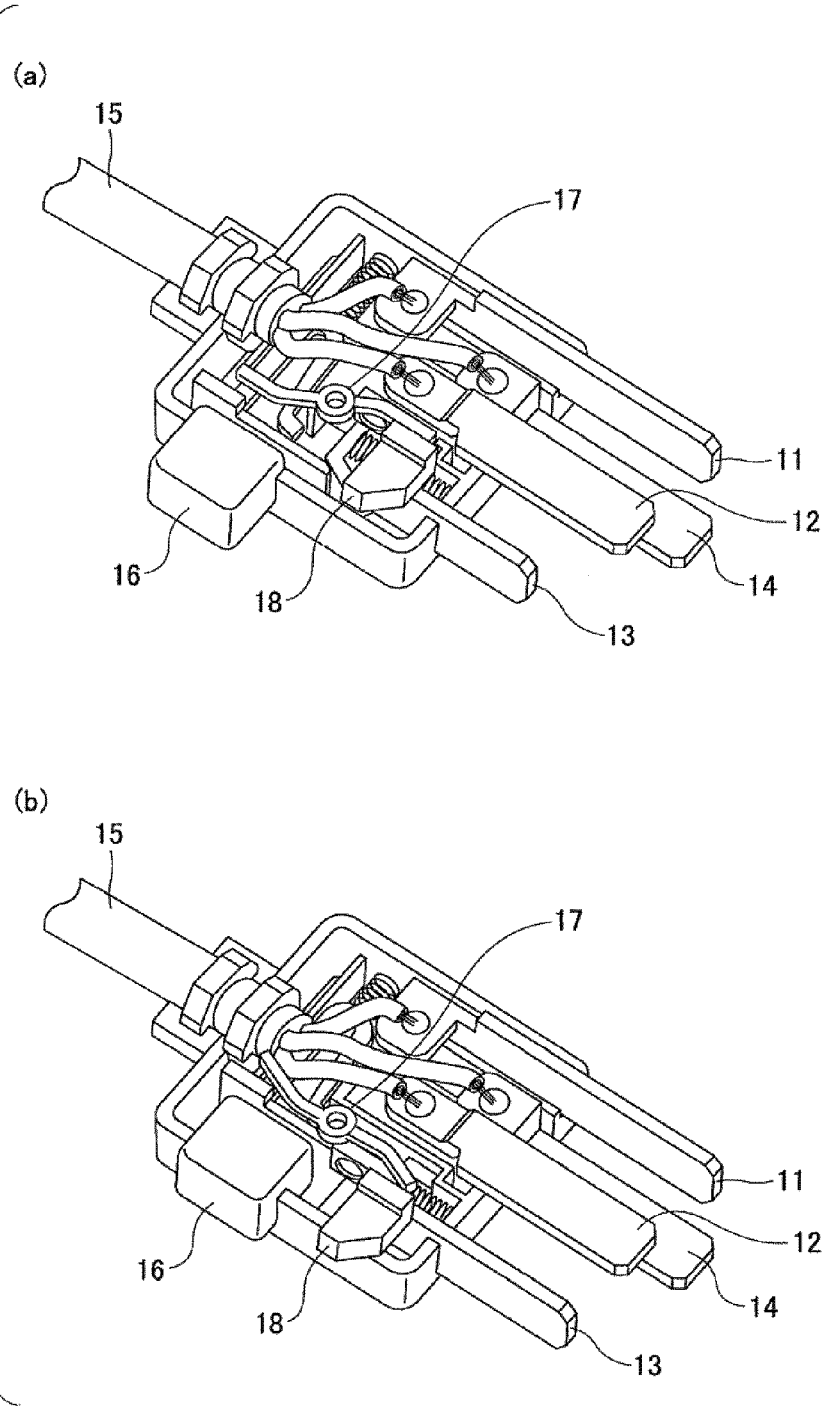
FIG. 3 is an internal structural view of an inserting connector of the first embodiment of the present invention.

FIG. 3(*a*) is a perspective view of an internal structure of a state where the control plug terminal 13 is retracted in the inserting connector 10 of the embodiment of the present invention. FIG. 3(*b*) is a perspective view of an internal structure of a state where the control plug terminal 13 is extended in the inserting connector 10 of the embodiment of the present invention.

Figure 4:
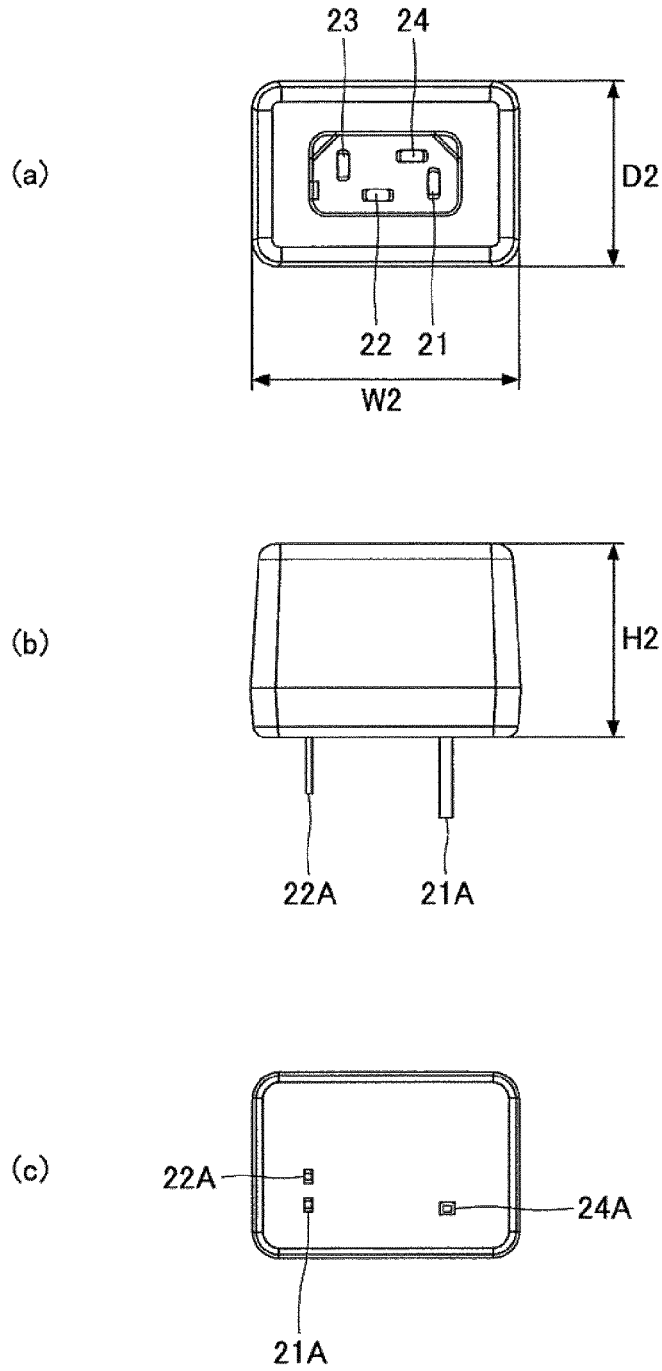
FIG. 4 is a structural view of a receiving connector of the first embodiment of the present invention.

FIG. 4(*a*) is a top view of the receiving connector 20 of the embodiment of the present invention. FIG. 4(*b*) is a side view of the receiving connector 20 of the embodiment of the present invention. FIG. 4(*c*) is a rear surface view of the receiving connector 20 of the embodiment of the present invention.

Figure 5:
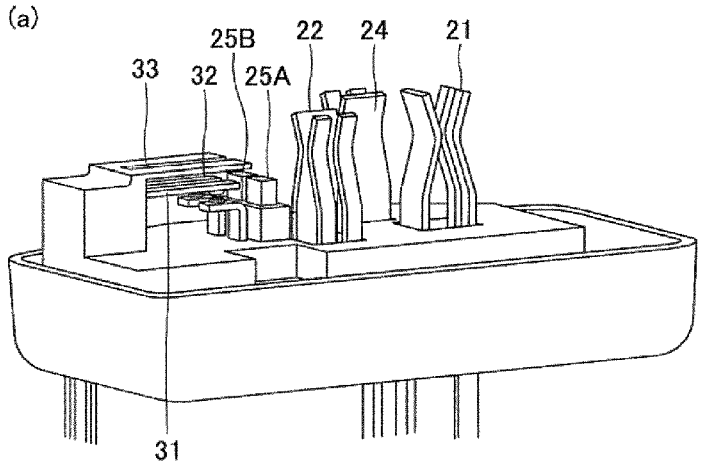
FIG. 5 is a perspective view of an internal structure of an inserting connector of the first embodiment of the present invention.
Figure 5:
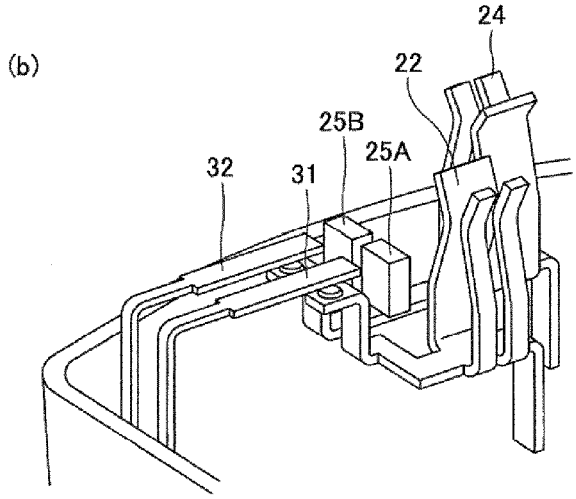

FIG. 5(*a*) is an internal structural view of the receiving connector 20 of the embodiment of the present invention. FIG. 5(*b*) is an expanded view of the vicinities of the control switches 31 and 32 of the receiving connector 20.

The inserting connector 10 shown in FIG. 2(*a*) has width W1 of approximately 30 mm, length D1 of approximately 30 mm, and height H1 of approximately 16 mm. A DC electric power source cable 15 of 400 VDC is connected to the inserting connector 10. The electric power plug terminals 11 and 12, the control plug terminal 13, and the ground plug terminal 14 made of metal are provided at a side of the inserting connector 10 opposite a side where the cable 15 is connected. The length A of the electric power plug terminals 11 and 12 is approximately 17 mm. The length B of the ground plug terminal 14 is approximately 19 mm.

Just after being inserted in the receiving connector 20, the inserting connector 10 of the embodiment of the present invention is in a state shown in FIG. 3(*a*). After this, by pushing a pushing button 16, the control plug terminal 13 is extended and a hinge 17 is rotated. As a result of this, a lock terminal 18 projects in a direction perpendicular to the inserting direction so that a state shown in FIG. 3(*b*) is formed.

On the other hand, as shown in FIG. 2(*b*) and FIG. 4, the receiving connector 20 of the embodiment of the present invention has a structure where a part of the main body of the inserting connector 10 is engaged with the receiving connector 20.

The receiving connector 20 includes the electric power jack terminals 21 and 22, the ground jack terminal 24, and the control jack terminal 23. The electric power jack terminals 21 and 22 are configured to be connected to the electric power plug terminals 11 and 12. The ground jack terminal 24 is configured to be connected to the ground plug terminal 14. The control jack terminal 23 is configured to be connected to the control plug terminal 13 in a state where the control plug terminal 13 is extended.

A terminal connected to a main body of a PDU (Power Distribution Unit) discussed below is provided at a rear surface of the main body of the receiving connector 20. More specifically, electric power terminals 21A and 22A and a ground terminal 24A are provided at the rear surface of the main body of the receiving connector 20. The electric power terminal 21A is connected to the electric power jack terminal 21 via the control switch 31. The electric power terminal 22A is connected to the electric power jack terminal 22 via the control switch 32. The ground terminal 24A is connected to the ground jack terminal 24.

The receiving connector 20 shown in FIG. 4 has width W2 of approximately 56 mm, length D2 of approximately 40 mm, and height H2 of approximately 40.5 mm.

FIG. 5(*a*) and FIG. 5(*b*) show internal structures of the receiving connector 20. The two control switches 31 and 32 are provided inside the control jack terminal 23 of the receiving connector 20. When the insulation plate spring 33 provided above the two control switches 31 and 32 is pushed from an upper part so as to be bent, contacts of the two control switches 31 and 32 come in contact and thereby an electric current flows.

Since the flowing electric current is 400 VDC, it is dangerous that the head end of the control plug terminal 13 of the receiving connector 10 directly pushes the two control switches 31 and 32 so that the contacts come in contact. Accordingly, in this example, the contacts of the two control switches 31 and 32 come in contact via the insulation plate spring 33. In this example, permanent magnets 25A and 25B for preventing arcing are provided in the vicinities of the contacts of the control switches 31 and 32.

Figure 6:
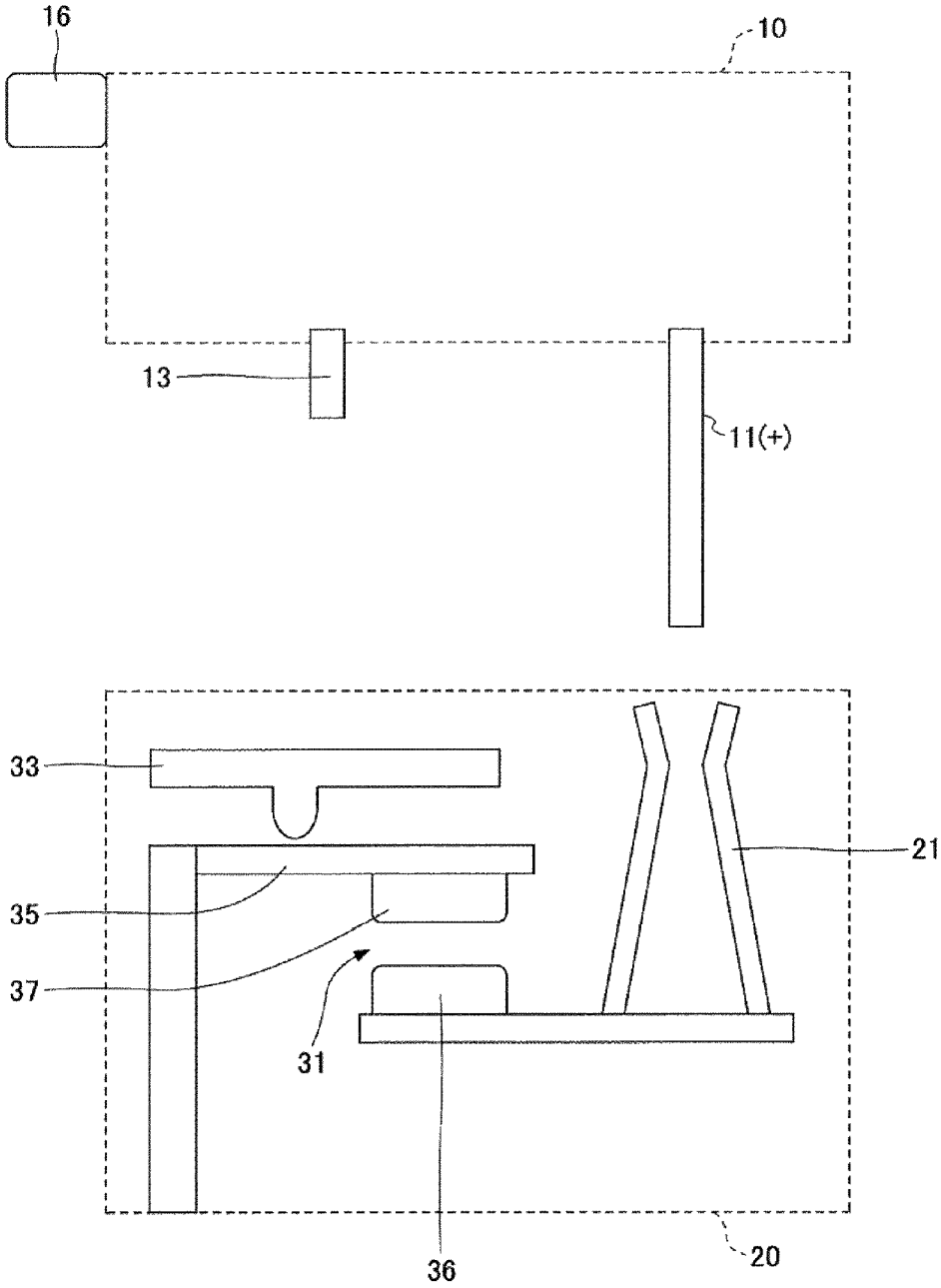
FIG. 6 is a first view for explaining a connection method of the connector unit of the first embodiment of the present invention.
Figure 7:
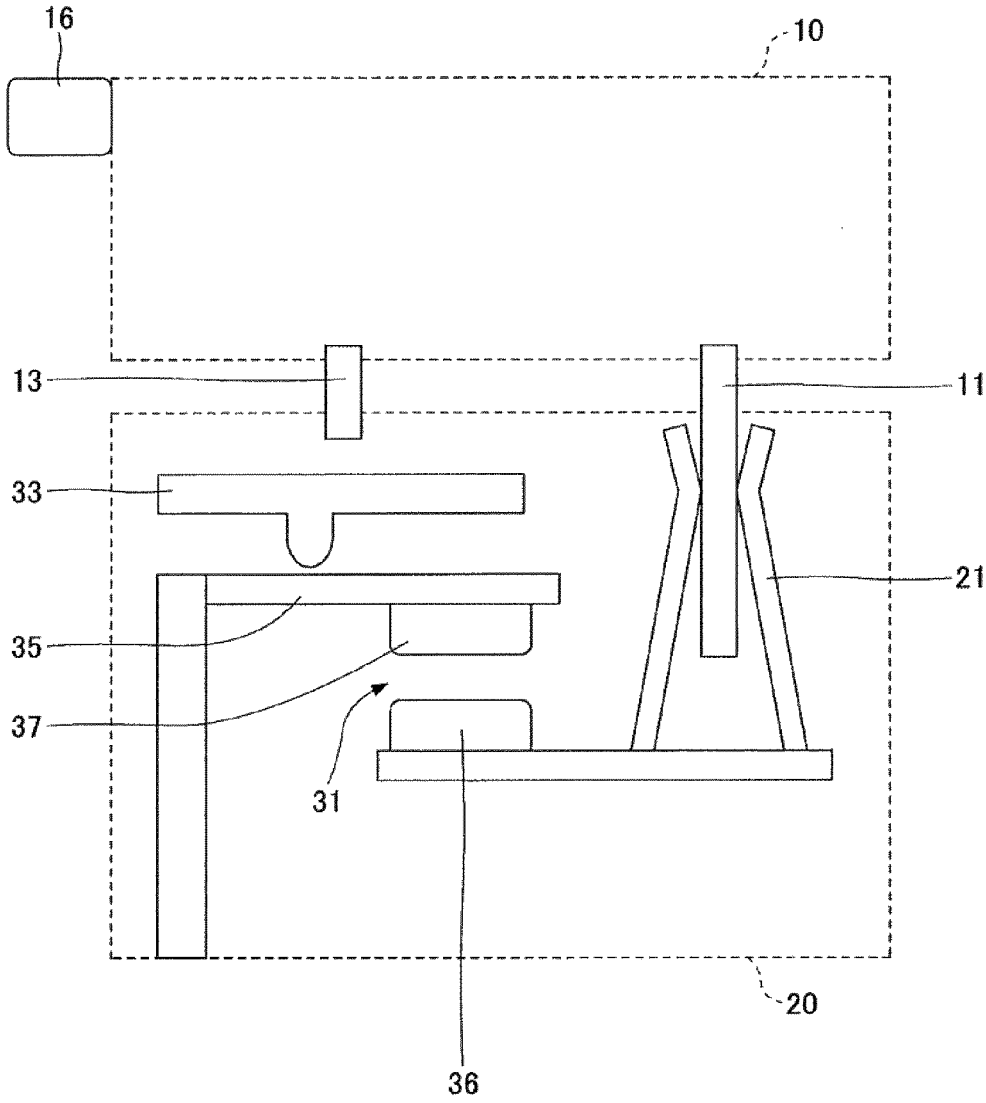
FIG. 7 is a second view for explaining the connection method of the connector unit of the first embodiment of the present invention.
Figure 8:
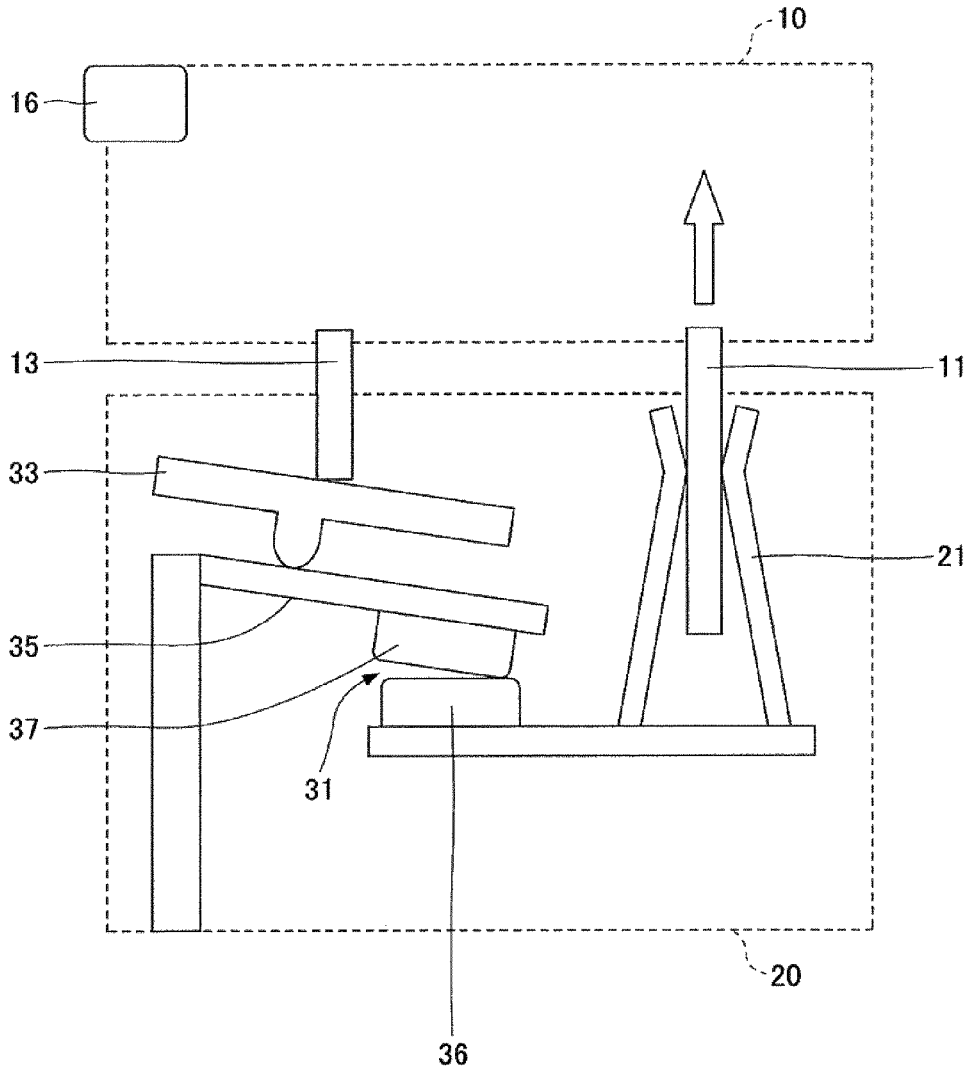
FIG. 8 is a third view for explaining the connection method of the connector unit of the first embodiment of the present invention.

Next, a connecting method of the inserting connector 10 and the receiving connector 20 of the embodiment of the present invention is discussed with reference to FIG. 6 through FIG. 8. FIG. 6 through FIG. 8 are first through third views for explaining the connection method of the inserting connector 10 and the receiving connector 20 of the first embodiment of the present invention. Each of FIG. 6 through FIG. 8 shows a schematic structure of a cross section.

FIG. 6 shows a state before the inserting connector 10 and the receiving connector 20 are connected to each other. In a state shown in FIG. 6, the electric power plug terminal 11 of the inserting connector 10 is not connected to the electric power jack terminal 21.

Similarly, the electric power plug terminal 12 shown in FIG. 1 and the electric power jack terminal 22 are not connected to each other. The ground plug terminal 14 and the ground jack terminal 24 are not connected to each other. In addition, the control plug terminal 13 is retracted. The pushing button 16 configured to extend and retract the control plug terminal 13 projects.

On the other hand, in the receiving connector 20, the control switch 31 and the electric power jack terminal 21 are connected to each other. More specifically, the control switch 31 includes a plate spring part 35 and contacts 36 and 37. The contact 36 is connected to the electric power jack terminal 21. The plate spring part 35 is formed of a metal plate spring. The contact 37 is connected to the electric power source 50 via the plate spring part 35.

Similarly, the electric power plug terminal 12 shown in FIG. 1 is connected to the electric power jack terminal 22. The control switch 32 is connected to the electric power source 50. In addition, when a force is applied from an upper part of the insulation plate spring 33, the insulation plate spring 33 provided above the control switches 31 and 32 is deformed, so that the force is transmitted to the control switches 31 and 32.

Next, a state where the inserting connector 10 is inserted in the receiving connector 20 is shown in FIG. 7. In this state, the electric power jack terminal 21 and the electric power plug terminal 11 of the receiving connector 10 are engaged with each other.

Similarly, the electric power plug terminal 12 and the electric power jack terminal 22 shown in FIG. 1 are engaged with each other. The ground plug terminal 14 and the ground jack terminal 24 are engaged with each other. In this state, the control plug terminal 13 is kept retracted, and the pushing button 16 configured to extend and retract the control plug terminal 13 is kept projecting. Accordingly, the contact 37 and the contact 36 of the control switch 31 of the receiving connector 20 are not connected. Similarly, the contact 39 and the contact 38 of the control switch 32 not shown are not connected.

A state where the inserting connector 10 is inserted in the receiving connector 20 and the control plug terminal 13 extends is shown in FIG. 8.

More specifically, by pushing the pushing button 16, the control plug terminal 13 extends, and the head end of the control plug terminal 13 pushes the insulation plate spring 33 so that the plate spring 33 is bent. Due to the bending of the insulation plate spring 33, the plate spring part 35 of the control switch 31 is bent so that the contact 37 and the contact 36 of the control switch 31 are connected.

By connecting the contact 37 and the contact 36 of the control switch 31, electric power from the electric power source 50 shown in FIG. 1 is supplied to the electric power jack terminal 21. Similarly, the electric power is supplied to the electric power jack terminal 22 shown in FIG. 1. As a result of this, the electric power is supplied from the electric power source 50 to the information apparatus 40 such as a server shown in FIG. 1 connected to the inserting connector 10, via the electric power plug terminals 11 and 12 connected to the electric power jack terminals 21 and 22.

Next, contacts 36 and 37 of the control switch 31 and contacts 38 and 39 of the control switch 32 are discussed with reference to FIG. 9.

As shown in FIG. 5, the permanent magnet 25A is provided in the vicinities of the contacts 36 and 37 of the control switch 31. The permanent magnet 25B is provided in the vicinities of the contacts 38 and 39 of the control switch 32.

Figure 9:
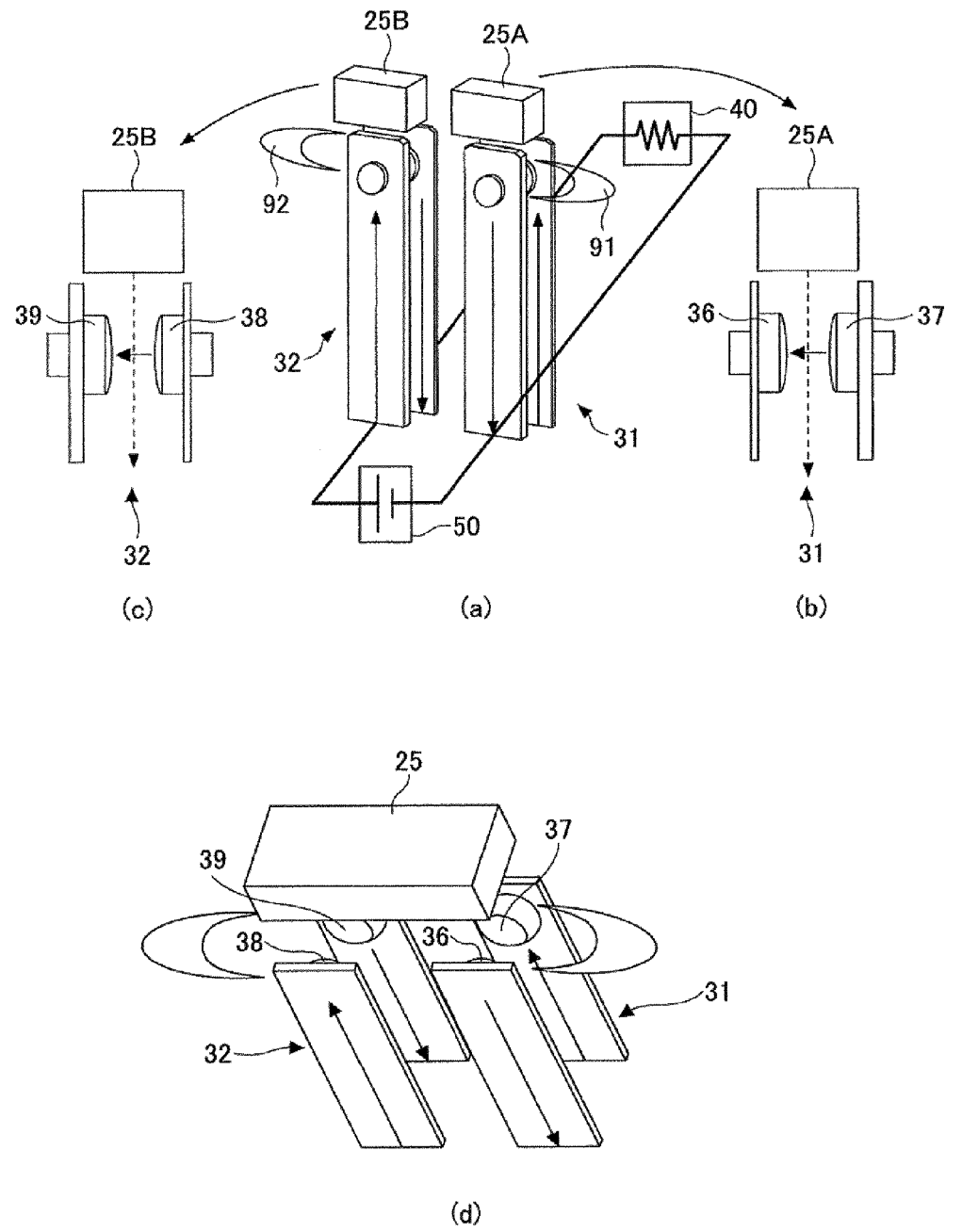
FIG. 9 is a fourth view for explaining the connection method of the connector unit of the first embodiment of the present invention.

Referring to FIG. 9(*a*), straight lines in the control switch 31 indicate directions of the electric current flowing when the contacts 36 and 37 are connected. Straight lines in the control switch 32 indicate directions of the electric current flowing when the contacts 38 and 39 are connected. In this connected state, the electric current being supplied from the electric power source 50 flows through the controls switches 31 and 32 and is supplied to the information apparatus 40 such as the server.

Here, when the control plug terminal 13 is retracted, the contacts 36 and 37 of the control switch 31 and the contacts 38 and 39 of the control switch 32 are opened so that the flow of the electric current stops. At this moment, arcing (arcing electric current) is generated between the contacts 36 and 37 and between the contacts 38 and 39.

In this case, by providing the permanent magnet 25A in the vicinities of the contacts 36 and 37, as shown in FIG. 9(*b*), magnetic flux indicated by a dotted line is generated due to the permanent magnet 25A. Thereby, a Lorentz force is generated based on Fleming's left-hand rule. As a result of this, as shown in FIG. 9(*a*), the arcing is deflected as indicated by the numerical reference 91 in FIG. 9(*a*) so as to be taken out.

Furthermore, by providing the permanent magnet 25B in the vicinities of the contacts 38 and 39, as shown in FIG. 9(*c*), magnetic flux indicated by a dotted line is generated due to the permanent magnet 25B. Thereby, another Lorentz force is generated based on Fleming's left-hand rule. As a result of this, as shown in FIG. 9(*a*), the arcing is deflected as indicated by the numerical reference 92 in FIG. 9(*a*) so as to be taken out.

As a result of this, supplying of the electric power is immediately blocked, and therefore it is possible to-achieve higher safety.

In the above-discussed example, a case where two permanent magnets 25A and 25B are used is explained. However, the present invention is not limited to this example. For example, as shown in FIG. 9(*d*), a single permanent magnet 25 formed of two permanent magnets 25A and 25B may be used.

Next, functions of the control plug terminal 13 and the lock terminal 18 are discussed with reference to FIG. 10 and FIG. 11.

Figure 10:
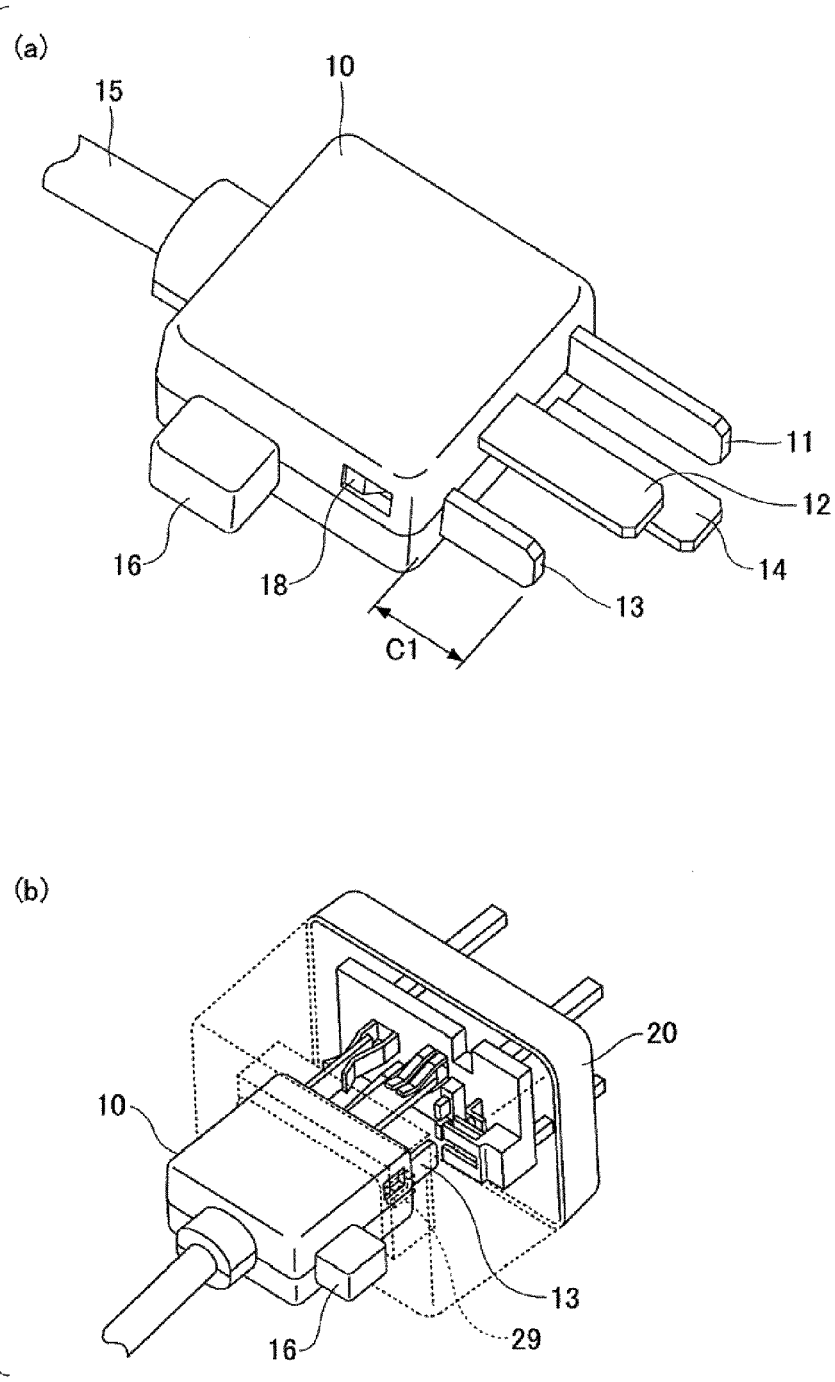
FIG. 10 is a perspective view of a state where a control plug terminal of the connector unit of the first embodiment of the present invention is retracted.

FIG. 10(*a*) is a perspective view of a state where the control plug terminal 13 is retracted in the inserting connector 10 of the embodiment of the present invention. FIG. 10(*b*) is a perspective view of a state where the inserting connector 10 and the receiving connector 20 are engaged with each other and the control plug terminal 13 is retracted.

Figure 11:
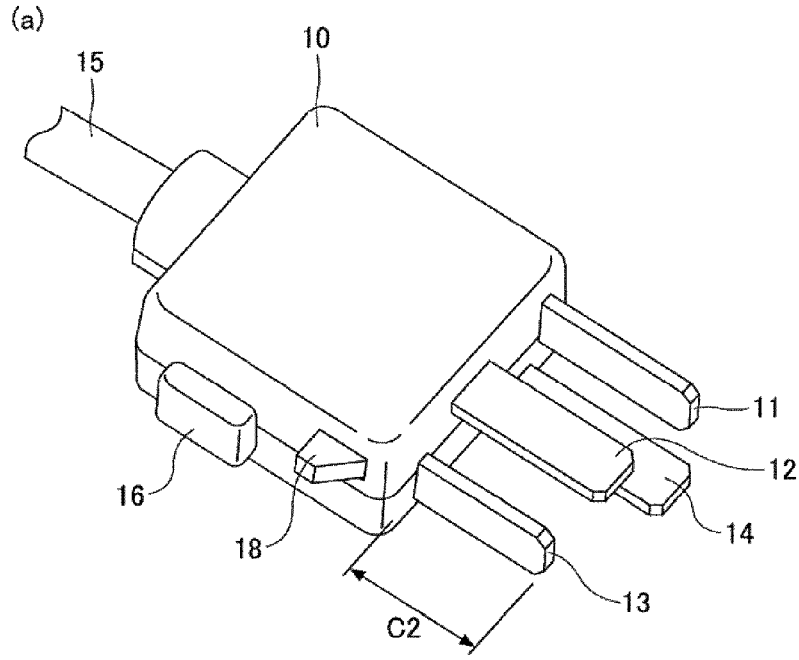
FIG. 11 is a perspective view of a state where the control plug terminal of the connector unit of the first embodiment of the present invention is extended.
Figure 11:
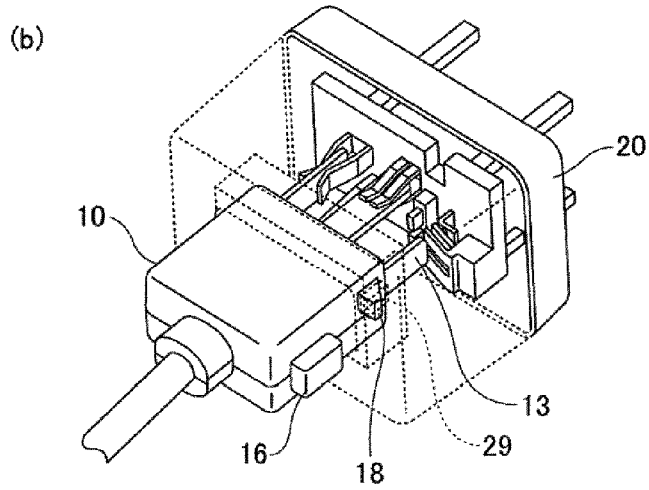

FIG. 11(*a*) is a perspective view of a state where the control plug terminal 13 is extended in the inserting connector 10 of the embodiment of the present invention. FIG. 11(*b*) is a perspective view of a state where the inserting connector 10 and the receiving connector 20 are engaged with each other and the control plug terminal 13 is extended.

As shown in FIG. 10(*a*), the length C1 in the state where the control plug terminal 13 is retracted is 10 mm. As shown in FIG. 11(*a*), the length C2 in the state where the control plug terminal 13 is extended is 14.5 mm.

As shown in FIG. 10(*b*), a concave part 29 which corresponds to the projected lock terminal 18 is formed in the receiving connector 20. As shown in FIG. 11(*b*), in the concave part 29, when the lock terminal 18 projects, connection of the inserting connector 10 and the receiving connector 20 cannot be broken.

In the above-discussed embodiment of the present invention, by using the pushing button 16, the control plug terminal 13 is extended in the inserting direction and the lock terminal 18 projects. However, the present invention is not limited to this structure. A slide switch or the like which can move in the inserting direction, instead of the pushing button 16, may be used so that the control plug terminal 13 can be extended in the inserting direction and the lock terminal 18 can project.

Thus, the electric power is supplied from the electric power jack terminals 21 and 22 only in the state where the control plug terminal 13 is extended. This is because it is necessary to prevent the high voltage of 400 VDC from being applied to the electric power jack terminals 21 and 22 of the receiving connector 20 when the inserting connector 10 is not connected to the receiving connector 20.

In other words, if the high voltage of 400 VDC is applied to the electric power jack terminals 21 and 22 of the receiving connector 20 when the inserting connector 10 is not connected to the receiving connector 20, the following problem may occur. That is, when a human touches the electric power jack terminals 21 and 22 in error or makes contact with the electric power jack terminals 21 and 22 via a driver, a metal piece, a cut wire, or the like, the human body may be injured. Hence, it is necessary to prevent such a problem from occurring.

Thus according to the connector unit of the embodiment of the present invention, when the control plug terminal 13 is pushed in a state where the electric power plug terminals 11 and 12 of the inserting connector 10 are engaged with the electric power jack terminals 21 and 22 of the receiving connector 20, an electric current flows via the control switch provided at the control jack terminal 23. As a result of this, electric power is supplied to the information apparatus 40 via the electric power jack terminals 21 and 22, and the electric power plug terminals 11 and 12 of the inserting connector 10.

(Electric Power Supply System)

Next, a structure of an electric power supply system using the connector unit of the embodiment of the present invention is discussed.

Figure 12:
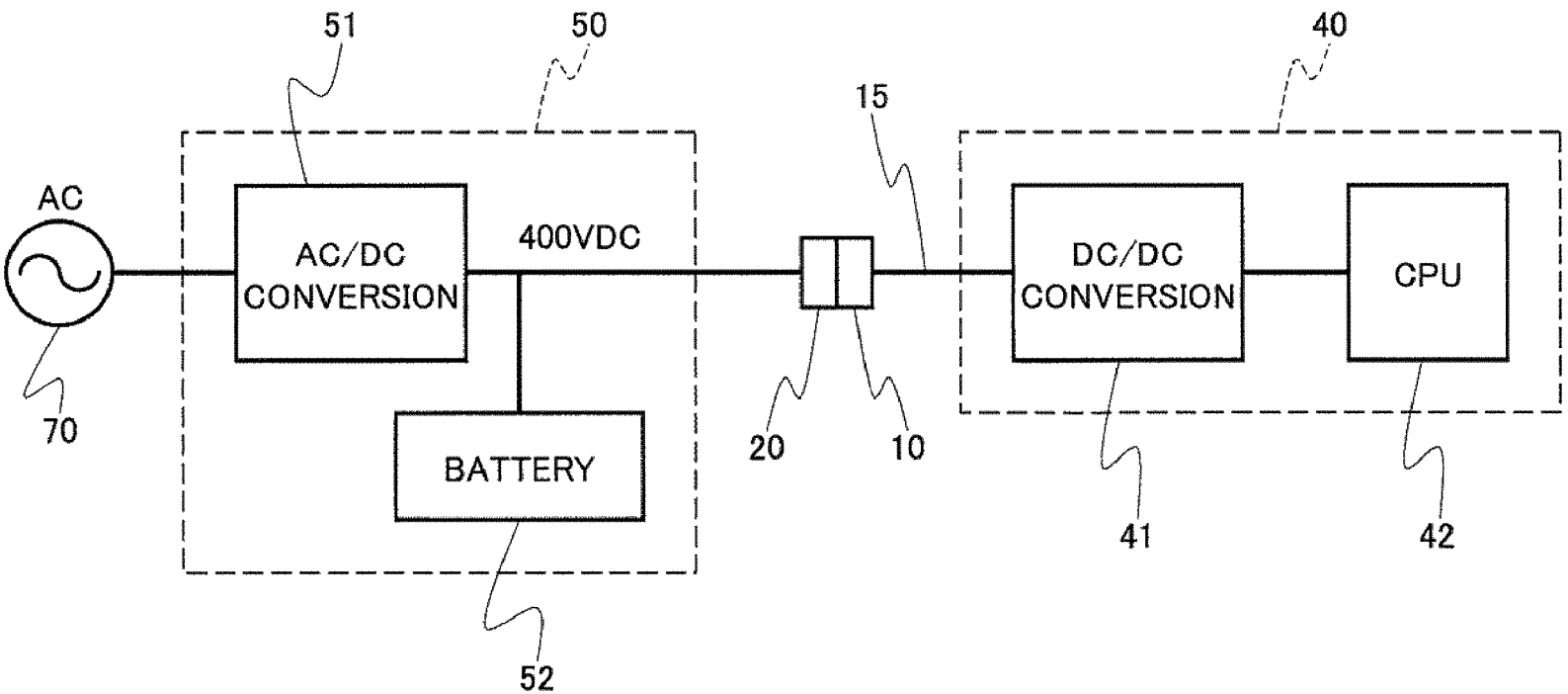
FIG. 12 is a structural diagram of an electric power source supply system using the connector unit of the first embodiment of the present invention.

FIG. 12 is a structural diagram of the electric power source supply system using the connector unit of the first embodiment of the present invention.

In this electric power supply system, a voltage of AC 100 V or AC 200 V supplied from the commercial electric power source 70 is input to the high voltage electric power source 50 so as to be converted to DC 400 V by an AC/DC convertor 51 of the high voltage electric power source 50. Direct current electric energy can be stored in a battery or the like. Therefore, by providing a backup battery 52, it is possible to easily respond in a case of a power outage or the like.

The receiving connector 20 of the embodiment of the present invention is connected to the high voltage electric power source 50 via an electric power source cable, so that electric power of 400 VDC from the high voltage electric power source 50 is supplied from the receiving connector 20.

On the other hand, the inserting connector 10 of the embodiment of the present invention is connected to the information apparatus 40 such as a server via the electric power source cable 15. By electrically connecting the inserting connector 10 and the receiving connector 20, the electric power is supplied from the high voltage electric power source 50 to the information apparatus 40 such as the server.

In addition, a DC/DC convertor 41 is provided in the information apparatus 40 such as the server. The DC/DC convertor 41 is configured to convert 400 VDC to a DC output having a low voltage whereby an electronic component such as the CPU 42 can be operated.

In the above-discussed electric power supply system, there are several advantages. For example, since conversion from the AC of the commercial electric power source 70 to the DC is required only one time, electric power loss is small. In addition, there is no need to pay attention to the width of the wire with a high voltage direct current 400 VDC. Because of the direct current, it is possible to store electric energy in the battery 52 and it is possible to easily respond when the supply from the commercial electric power source 70 stops due to a power outage.

Next, a PDU (Power Distribution Unit) using the connector unit of the embodiment of the present invention is discussed with reference to FIG. 13.

Figure 13:
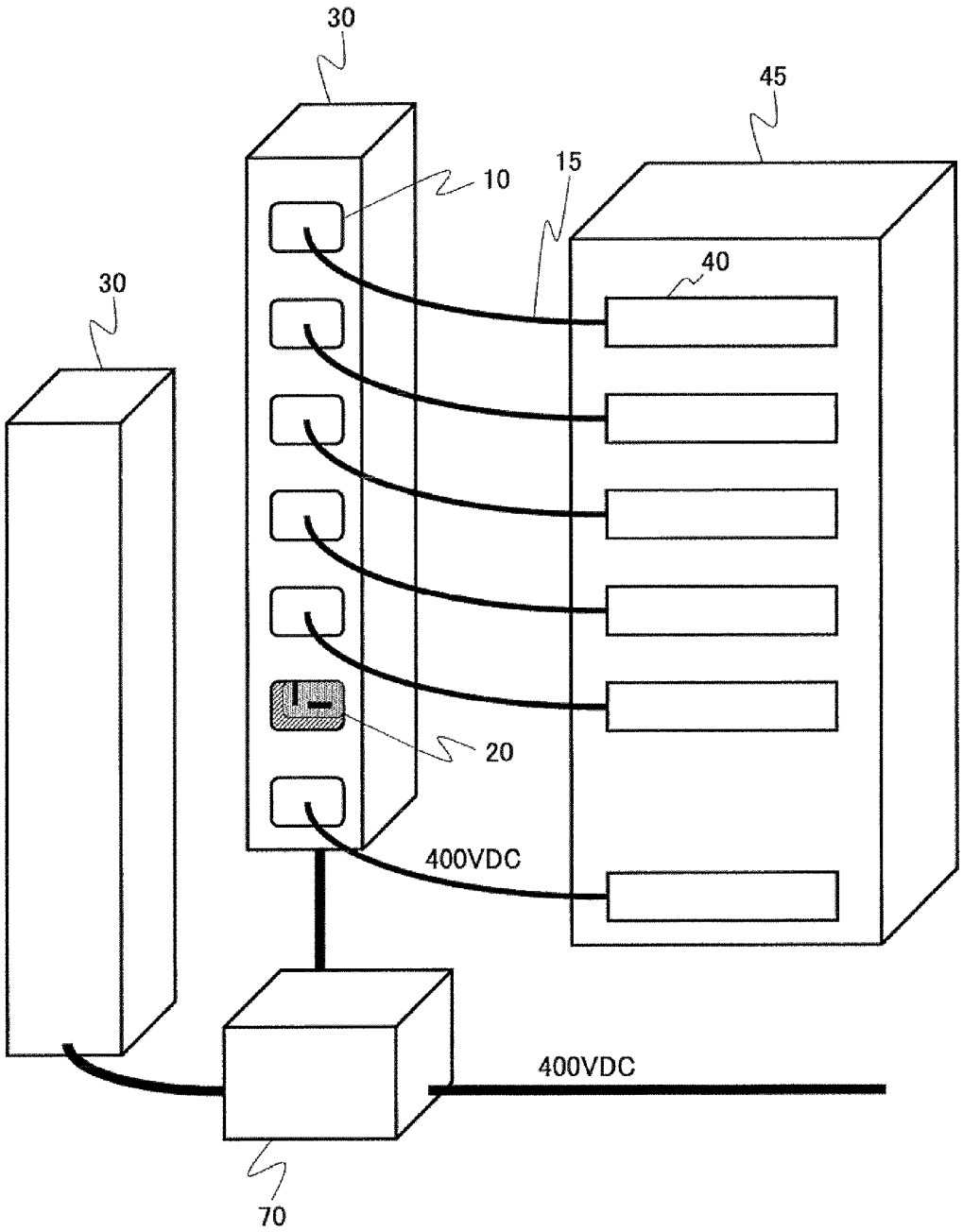
FIG. 13 is a perspective view of a PDU (Power Distribution Unit) using the connector unit of the first embodiment of the present invention.

Here, FIG. 13 is perspective view of the PDU using the connector unit of the first embodiment of the present invention.

The electric power of 400 VDC supplied from the high voltage electric power source shown in FIG. 12 is input to its distribution board 70 for a while so that the electric power is distributed to each PDU 30. Plural of the receiving connectors 20 of the embodiment of the present invention are provided in each PDU 30. It is possible to supply the electric power of 400 VDC via each receiving connector 20.

On the other hand, plural of the information apparatuses 40 such as servers are installed in a server rack 45. The inserting connectors 10 configured to receive a supply of power from the electric power source are connected to the corresponding information apparatuses 40 such as the servers via the DC electric power source cables 15. By electrically connecting the inserting connectors 10 to the receiving connectors 20 provided in the PDU 30, the electric power of 400 VDC can be supplied.

In addition, in the above-discussed example, the case of 400 VDC is explained. However, the inserting connector, the receiving connector, and the connector unit can be used as long as the electric current is a direct current (DC). In the case of DC, unlike AC, there is no frequency so that it is safe for humans.

From the perspective of influence on the human body, a voltage equal to or less than 48 V is normally used as a direct current voltage. This is because there is almost no influence due to electric shock if the voltage is equal to or less than 48 V. If the voltage is higher than 48 V, influence on human body is large and, especially, the voltage equal to or higher than 200 V is dangerous.

In the inserting connector, the receiving connector, and the connector unit of this embodiment, safety is improved by a structure different from the conventional art. Hence, safety in the case of the voltage higher than 48 V, especially the voltage higher than 200V is improved and therefore the receiving connector and the connector unit of this embodiment are effective.

Second Embodiment

The second embodiment of the present invention is mainly related to the inserting connector. More specifically, in the fourth embodiment of the present invention, as discussed below, extension and retraction of the control plug is done with a slide switch.

Figure 14:
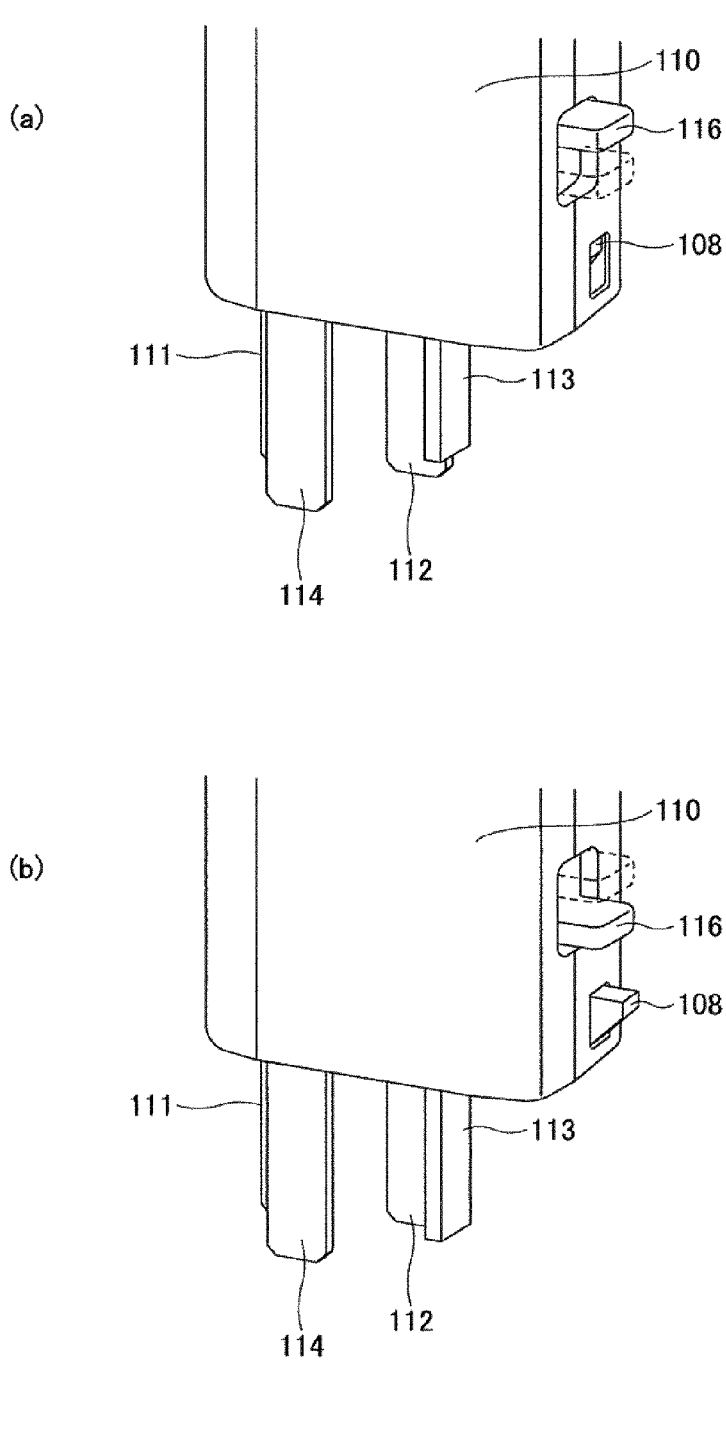
FIG. 14 is a perspective view of an internal structure of an inserting connector of a second embodiment of the present invention.

FIG. 14 shows a structure of the inserting connector of the fourth embodiment of the present invention. More specifically, FIG. 14(*a*) is a perspective view of an inserting connector 110 in a state where a control plug terminal 113 is retracted. FIG. 14(*b*) is a perspective view of the inserting connector 110 in a state where the control plug terminal 113 is extended.

The inserting connector 110 includes two electric power plug terminals 111 and 112 for receiving the supply of the electric power, the control plug terminal 113, a ground plug terminal 114, a slide switch 116, and a lock terminal 108.

The control plug terminal 113 is extended by sliding the slide switch 116 in the inserting direction of the control plug terminal 113 from the retracted state shown In FIG. 14(*a*) to the extended state shown in FIG. 14(*b*).

Figure 15:
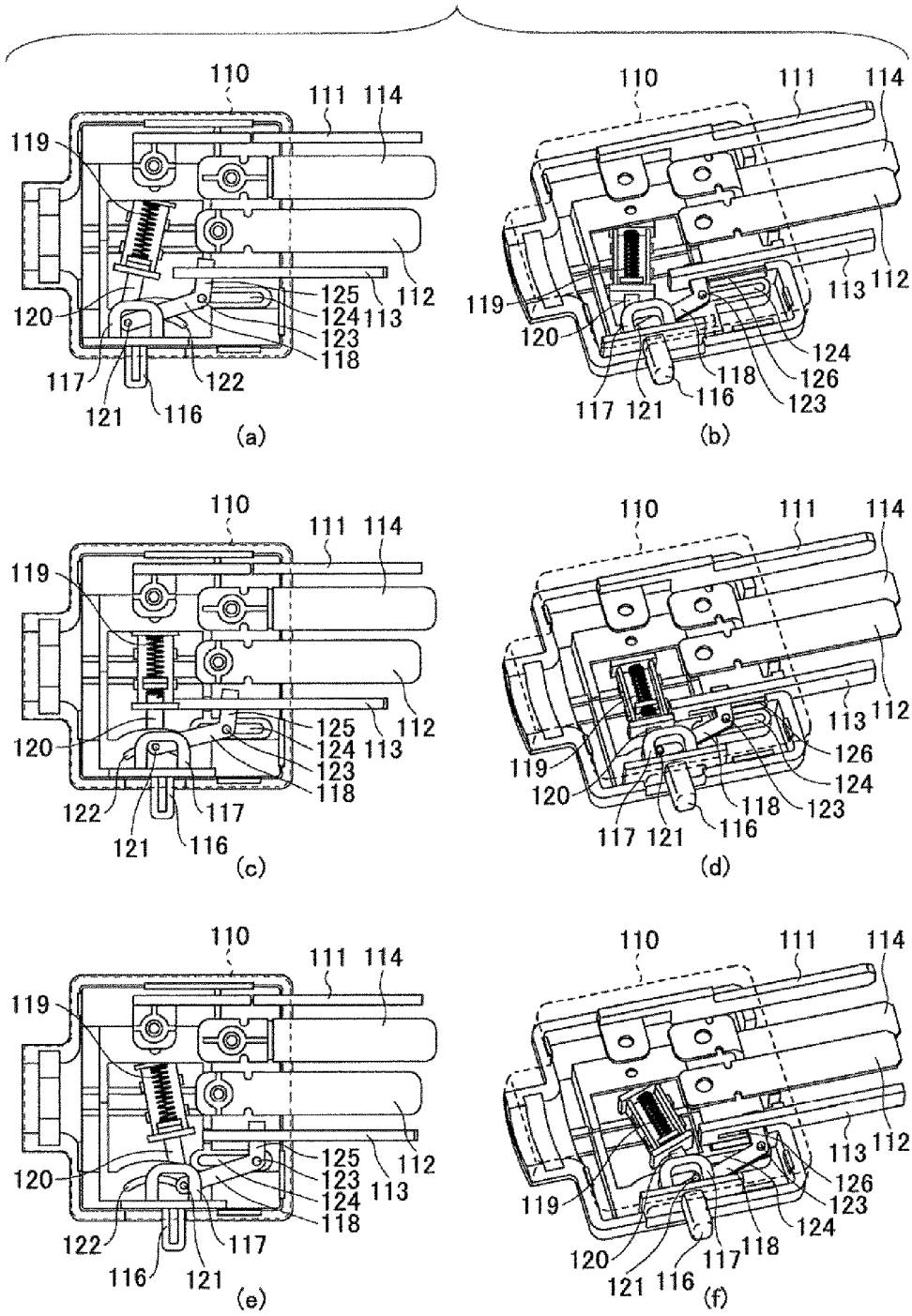
FIG. 15 is a view for explaining a case where a control plug terminal of an inserting connector of the second embodiment of the present invention is extended.
Figure 16:
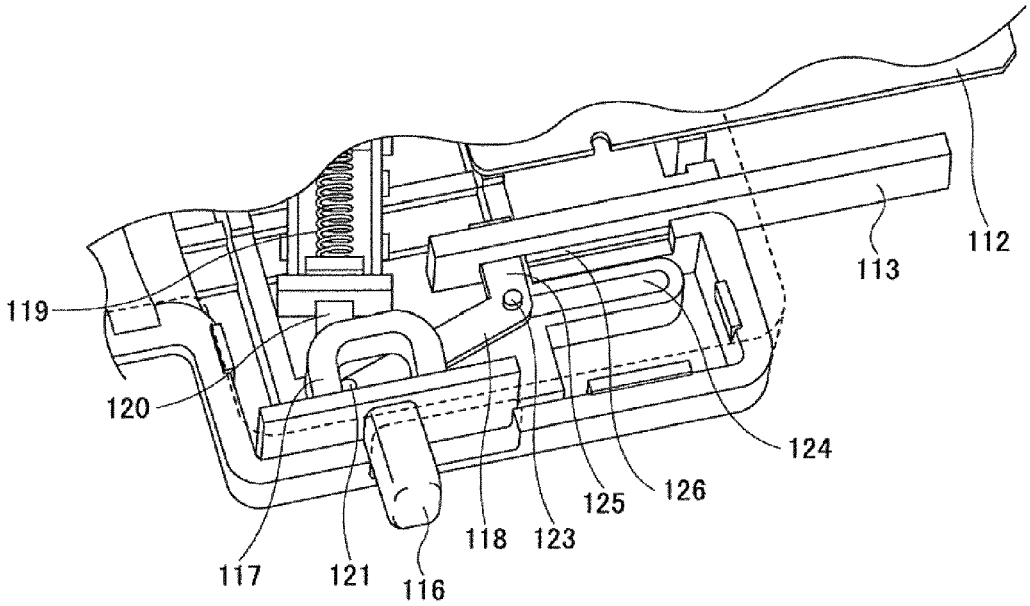
FIG. 16 is a perspective view of an internal structure of the inserting connector of the second embodiment of the present invention.

Next, with reference to FIG. 15 and FIG. 16, a case where the control plug terminal 113 is extended in the inserting connector 110 of this embodiment is discussed. By extending the control plug terminal 113, a contact of a switch provided at the control jack terminal of the receiving connector (not shown) is changed from open to closed.

FIG. 15(*a*) is an internal structural view of a state where the control plug terminal 113 is retracted. FIG. 15(*b*) is an internal perspective view of the state where the control plug terminal 113 is retracted. FIG. 15(*c*) is an internal structural view of an intermediate state between where the control plug terminal 113 is retracted and where the control plug terminal 113 is extended. FIG. 15(*d*) is an internal perspective view of the intermediate state between where the control plug terminal 113 is retracted and where the control plug terminal 113 is extended. FIG. 15(*e*) is an internal structural view of the state where the control plug terminal 113 is extended. FIG. 15(*f*) is an internal perspective view of the state where the control plug terminal 113 is extended. FIG. 16 is a partially expanded view of FIG. 15(*b*).

As shown in FIG. 15(*a*) and FIG. 15(*b*), in the slide switch 116, a U-shaped part 117 is provided inside the inserting connector 110. The control plug terminal 113 extends via a control plug terminal link 118.

In addition, a coil spring 119 is provided inside the inserting connector 110. The coil spring 119 is connected to one end of a transmitting part 120. The transmitting part 120 is configured to transmit the expansion and compression of the coil spring 119. Another end of the transmitting part 120 is connected to a cam shaft 121 of the control plug terminal link 118 where the end part of the transmitting part 120 can be rotated, and the cam shaft 121 can be moved in a cam groove 122.

Furthermore, a slide shaft 123 is provided in the control plug terminal link 118 so as to move in a slide groove 124. In addition, a head end part 125 of the control plug terminal link 118 is inserted in a buffer groove 126 provided in the control plug terminal 113 so as to move in the buffer groove 126.

In the state where the control plug terminal 113 is retracted, the slide switch 116 and the control plug terminal link 118 are positioned at a left side in FIG. 15. The cam shaft 121 is positioned on a leftmost side in the cam groove 122 and comes in contact with an internal part wall surface of the left side of the U-shaped part 117. Furthermore, the slide shaft 123 of the control plug terminal link 118 is positioned at a left side in the slide groove 124. The head end part 125 comes in contact with a left end of the buffer groove 126. At this time, the coil spring 119 is slightly compressed.

After this, the slide switch 116 is moved in the inserting direction (right direction in FIG. 15) so as to be in the intermediate state shown in FIG. 15(*c*) and FIG. 15(*d*). In this intermediate state, a moving direction of the slide switch 116 is perpendicular to expansion and compression directions of the coil spring 119.

In this intermediate state, the slide switch 116 is positioned in the substantially center part in FIG. 15. In the control plug terminal link 118, the cam shaft 121 is pushed to the right side by the internal part wall surface at the left side of the U-shaped part 117 so as to move to the right side in the cam groove 122 and reach the center part in the cam groove 122.

At this time, although the head end part 125 of the control plug terminal link 118 moves to a right side, the retracted state of the control plug terminal 113 is maintained because the head end part 125 moves in the buffer groove 126. In this retracted state, the head end part 125 comes in contact with a right end of the buffer groove 126. In addition, in this retracted state compared to the positions shown in FIG. 15(*a*) and FIG. 15(*b*), the coil spring 119 is compressed more and therefore a force pushing the transmitting part 120 up due to a restoring force of the coil spring 119 becomes stronger.

After this, by further moving the slide switch 116 in the inserting direction (right direction in FIG. 15), positions shown in FIG. 15(*e*) and FIG. 15(*f*) are reached due to the restoring force of the coil spring 119.

In other words, due to the restoring force whereby the coil spring 119 expands, the cam shaft 121 moves in the cam groove 122 in the right direction in FIG. 15 via the transmitting part 120. As a result of this, v a the head end part 125 of the control plug terminal link 118, the right end of the buffer groove 126 is pushed and the control plug terminal 113 extends in the inserting direction.

In this extended state, the slide switch 116 and the control plug terminal link 118 are moved to the right side in FIG. 15. Furthermore, the cam shaft 121 is moved to a rightmost side in the cam groove 122 and comes in contact with an internal part wall surface of the right side of the U-shaped part 117. Furthermore, the slide shaft 123 of the control plug terminal link 118 is positioned at a right side in the slide groove 124. The head end part 125 comes in contact with a right end of the buffer groove 126. At this time, the coil spring 119 is slightly expanded compared to the intermediate state.

Thus, it is possible to extend the control plug terminal 113 in the inserting direction. Since the control plug terminal 113 is extended in the inserting direction due to the restoring force of the coil spring 119 from the intermediate state, namely a force whereby the coil spring 119 is expanded, this occurs for a short period of time.

Figure 17:
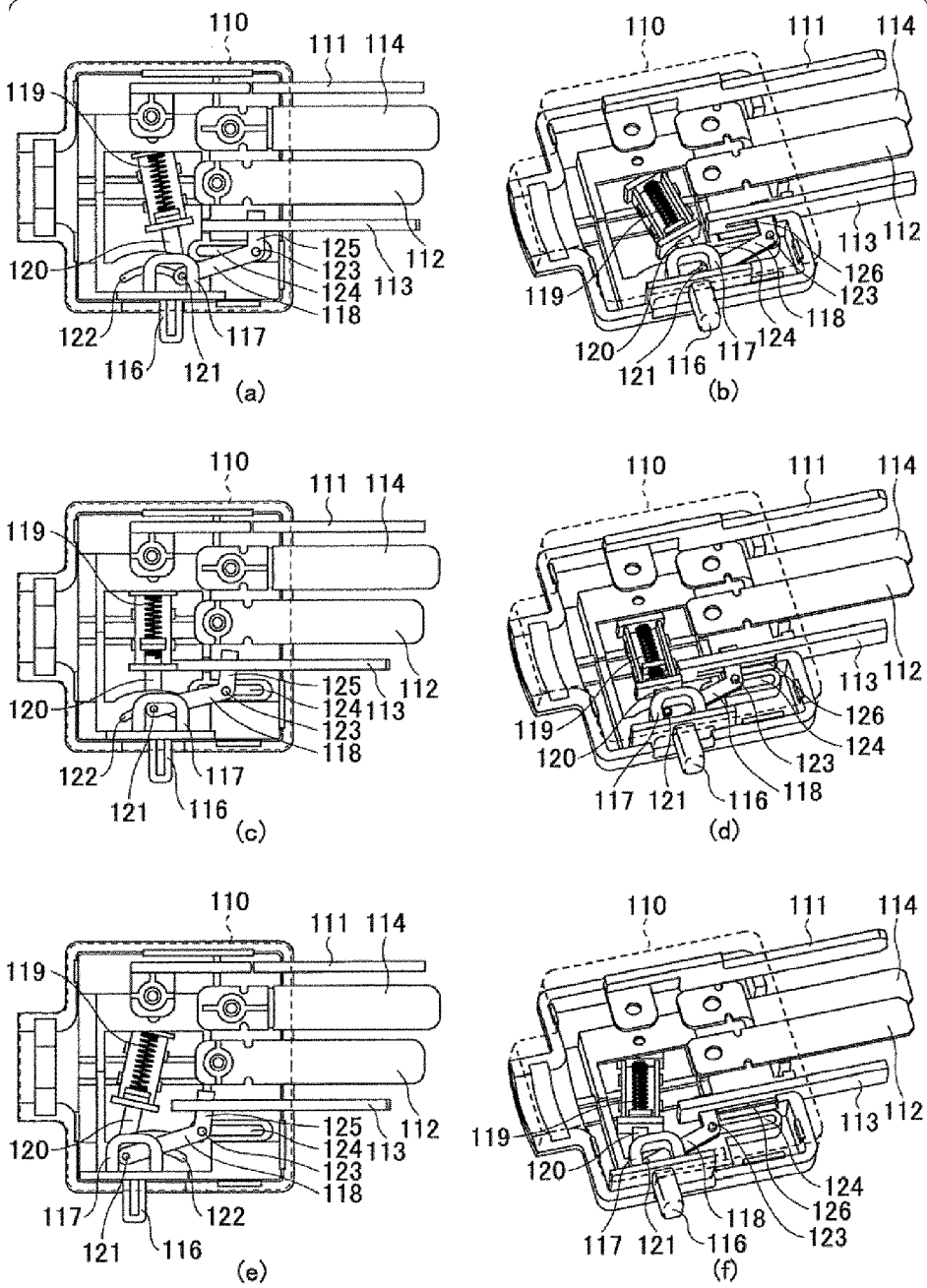
FIG. 17 is a view for explaining a case where the control plug terminal of the inserting connector of the second embodiment of the present invention is retracted.

Next, with reference to FIG. 17, a case where the control plug terminal 113 is retracted in the inserting connector 110 of this embodiment is discussed. By retracting the control plug terminal 113, a contact of a switch provided at the control jack terminal of the receiving connector (not shown) is changed from closed to open.

FIG. 17(*a*) is an internal structural view of a state where the control plug terminal 113 is extended. FIG. 17(*b*) is an internal perspective view of the state where the control plug terminal 113 is extended. FIG. 17(*c*) is an internal structural view of an intermediate state between where the control plug terminal 113 is extended and where the control plug terminal 113 is retracted. FIG. 17(*d*) is an internal perspective view of the intermediate state between where the control plug terminal 113 is extended and where the control plug terminal 113 is retracted. FIG. 17(*e*) is an internal structural view of the state where the control plug terminal 113 is retracted. FIG. 17(*f*) is an internal perspective view of the state where the control plug terminal 113 is retracted.

As shown in FIG. 17(*a*) and FIG. 17(*b*), in the state where the control plug terminal 113 is extended, the slide switch 116 and the control plug terminal link 118 are positioned at a right side in FIG. 17.

The cam shaft 121 is positioned at a rightmost side in the cam groove 122 and comes in contact with an internal part wall surface of the right side of the U-shaped part 117. Furthermore, the slide shaft 123 of the control plug terminal link 118 is positioned at a right side in the slide groove 124. A head end part 125 comes in contact with a right end of the buffer groove 126. At this time, the coil spring 119 is slightly compressed.

After this, the slide switch 116 is moved in the pulling direction (left direction in FIG. 17) so as to reach the intermediate state shown in FIG. 17(*c*) and FIG. 17(*d*). In this intermediate state, a moving direction of the slide switch 116 is perpendicular to an expansion and compression direction of the coil spring 119.

In this intermediate state, the slide switch 116 is positioned in the substantially center part in FIG. 17. In the control plug terminal link 118, the cam shaft 121 is pushed to the left side by the internal part wall surface at the right side of the U-shaped part 117 so as to move to the left side in the cam groove 122 and reach the center part in the cam groove 122.

At this time, although the head end part 125 of the control plug terminal link 118 moves to a left side, the extended state of the control plug terminal 113 is maintained because the head end part 125 moves in the buffer groove 126. In this extended state, the head end part 125 comes in contact with a right end of the buffer groove 126. In addition, in this extended state compared to the positions shown in FIG. 17(*a*) and FIG. 17(*b*), the coil spring 119 is compressed more and therefore a force pushing the transmitting part 120 up due to a restoring force of the coil spring 119 becomes stronger.

After this, by further moving the slide switch 116 in the pulling direction (left direction in FIG. 17), positions shown in FIG. 17(*e*) and FIG. 17(*f*) are attained due to the restoring force of the coil spring 119.

In other words, due to the restoring force whereby the coil spring 119 expands, the cam shaft 121 moves in the cam groove 122 in the left direction in FIG. 17 via the transmitting part 120. As a result of this, via the head end part 125 of the control plug terminal link 118, the left end of the butter groove 126 s pushed and the control plug terminal 113 is retracted in the inserting direction.

In this retracted state, the slide switch 116 and the control plug terminal link 118 are moved to the left side in FIG. 17. Furthermore, the cam shaft 121 is moved to a leftmost side in the cam groove 122 and comes in contact with an internal part wall surface of the left side of the U-shaped part 117. Furthermore, the slide shaft 123 of the control plug terminal link 118 is positioned at a left side in the slide groove 124. The head end part 125 comes in contact with a left end of the buffer groove 126. At this time, the coil spring 119 is slightly expanded compared to the intermediate state.

Thus, it is possible to retract the control plug terminal 113 in the inserting direction. Since the control plug terminal 113 is retracted in the inserting direction due to the restoring force of the coil spring 119 from the intermediate state, namely a force whereby the coil spring 119 is expanded, this is performed for a short period of time.

In the meantime, in a case where the coil spring 119 is not provided, the control plug terminal 113 is retracted and extended in the inserting direction by only a force of a finger of a human. Since the speed for retracting or extending differs depending on the human, the speed may be slow.

Due to the speed for retracting or extending being slow, arcing or chattering may be generated at a contact of the receiving connector (not shown) connected by the control plug terminal 113. Such arcing or chattering may damage the contact of the receiving connector or an apparatus connected to the inserting connector.

In the receiving connector 110 of this embodiment, the control plug terminal 113 can be retracted or extended In a short period of time. Accordingly, the above-mentioned arcing or chattering can be prevented from being generated. Hence, it is possible to prevent the contact of the receiving connector or the apparatus connected to the inserting connector from being damaged.

Next, a mechanism of the inserting connector of the embodiment is discussed with reference to FIG. 18.

Figure 18:
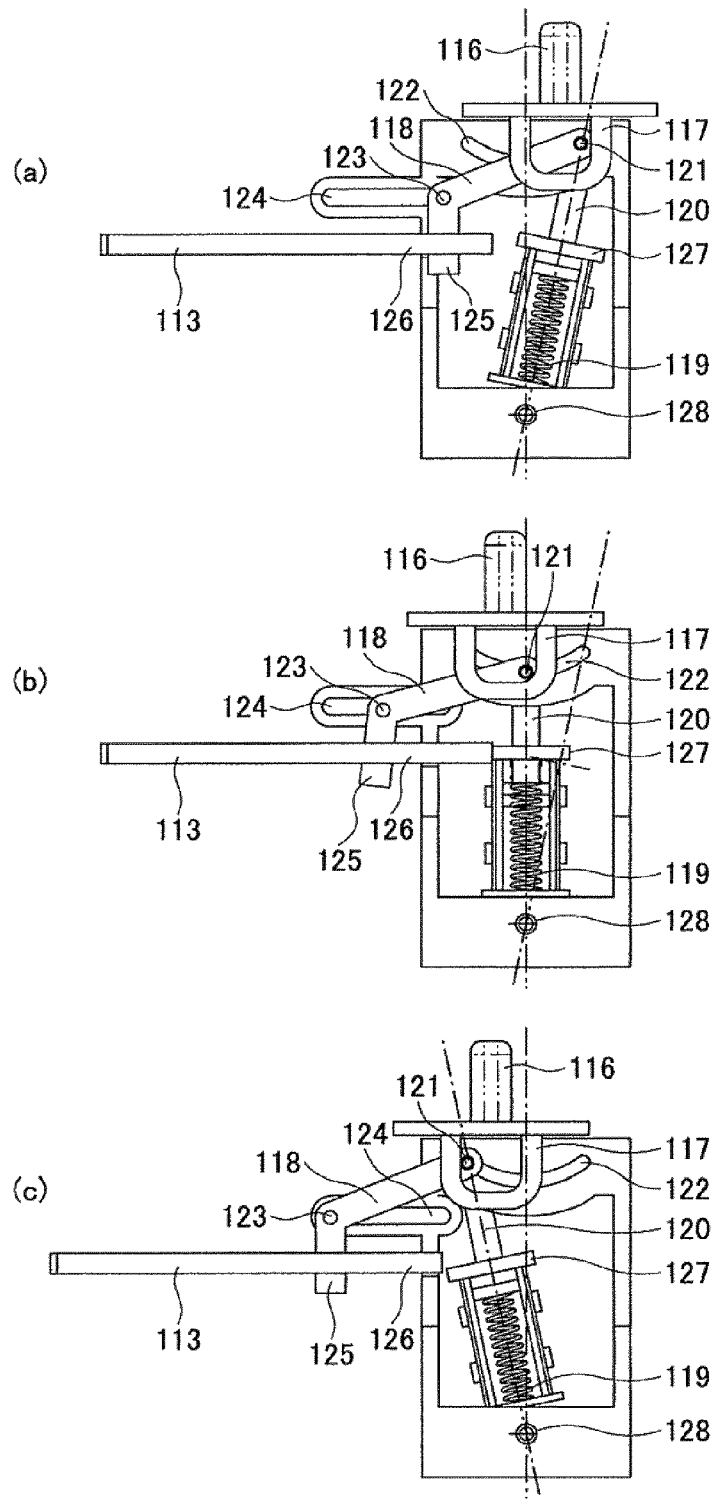
FIG. 18 is a partial cross-sectional view of the internal structure of the inserting connector of the second embodiment of the present invention.

FIG. 18(*a*) is a partial cross-sectional view of an inserting connector in the state where the control plug terminal 113 is retracted. FIG. 18(*b*) is a partial cross-sectional view of the inserting connector in the state where the control plug terminal 113 is in the intermediate state. FIG. 18(*c*) is a partial cross-sectional view of the inserting connector in the state where the control plug terminal 113 is extended.

The slide switch 116 is moved to the left side in FIG. 18(*a*) so that the cam shaft 121 is pushed to the left side by the internal part wall surface of the right side of the U-shaped part 117. As a result of this, the cam shaft 121 is moved to the left side in the cam groove 122 so that the control plug terminal link 118 is moved to the left side.

At this time, the coil spring 119 is compressed by the cam shaft 121 via the transmitting part 120. The coil spring 119 of the inserting connector 110 of this embodiment is received in a coil spring holder 127. An end of the coil spring 119 at a side not contacting the transmitting part 120 is fixed inside the coil spring holder 127. Furthermore, the coil spring holder 127 is rotatably supported by the housing of the inserting connector 110 and a rotational shaft 128.

As a result of this, the intermediate state shown in FIG. 18(*b*) is formed. In this state, the coil spring 119 is compressed and the restoring force in the extending direction is large.

After this, the slide switch 116 is further moved to the left side, and the transmitting part 120 is pushed up by the restoring force of the coil spring 119 so that the cam shaft 121 moves to the left side in the cam groove 122. As a result of this, the control plug terminal 113 is moved in the left direction via the head end part 125 of the control plug terminal link 118. In other words, the control plug terminal 113 is extended in the inserting direction so that the extended state shown in FIG. 18(*c*) is formed.

Thus, it is possible to push the control plug terminal 113 in a short period of time.

Similarly, in a case where the control plug terminal 113 is to be retracted, it is possible to retract the control plug terminal 113 from the intermediate state due to the restoring force of the coil spring 119. Hence, it is possible to retract the control plug terminal 113 in a short period of time.

In the above-discussed examples, by using a restoring force whereby the coil spring 119 is expanded from the compressed state, the control plug terminal 113 is retracted. However, by using a structure or the like of the cam groove 122, the restoring force whereby the coil spring 119 is compressed from the expanded state is used so that extension and retraction of the control plug terminal 113 can be performed.

In addition, although the coil spring 119 is used in the above-discussed examples, any elastic member can be used as Long as the same action can be performed.

Furthermore, the inserting connector of this embodiment, instead of the inserting connector of the first embodiment, can be used. For example, the inserting connector of this embodiment can be combined with the receiving connector of the first embodiment so that the connector unit can be formed.

According to the embodiments of the present invention, it is possible to provide an inserting connector, a receiving connector, and a connector unit whereby high voltage electric power can be safely supplied.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

What is claimed is:

1. An inserting connector connected to a receiving connector, the receiving connector being configured to electrically connect an electric power source and an electric apparatus receiving an electric power supply from the electric power source, the inserting connector being connected to the electric apparatus, the inserting connector comprising:

two electric power plug terminals made of a conductor, the conductor being configured to receive the electric power supply; and a control plug terminal configured to be extended and retracted in an inserting direction;

wherein the receiving connector is connected to the electric power source;

the receiving connector includes two electric power jack terminals corresponding to the electric power plug terminals; and a control jack terminal corresponding to the control plug terminal;

the control jack terminal includes two control switches connected to the two electric power jack terminals;

the electric power source is configured to supply electric power from the electric power jack terminals via the two control switches; and, contacts of the two control switches are connected by extending the control plug terminal in the control jack terminal in the inserting direction in a state where two electric power plug terminals and the two electric power jack terminals are engaged with each other, so that the electric power is supplied to the electronic apparatus.

2. The inserting connector as claimed in claim 1, wherein extension and retraction in the inserting direction of the control plug terminal is performed by a slide switch or a pushing button switch.

3. The inserting connector as claimed in claim 1, further comprising:

a slide switch configured to perform the extension and retraction in the inserting direction of the control plug terminal via a control plug terminal link; and an expandable and compressible coil spring;

wherein the inserting connector is in an intermediate state where a moving direction of the slide switch is perpendicular to an expansion and compression direction of the coil spring; and the coil spring is expanded and compressed by moving the slide switch.

4. The inserting connector as claimed in claim 3, wherein the coil spring is in an expanded state or a compressed state in the case of the intermediate state; and the control plug terminal is extended in the inserting direction via the control plug terminal link by a restoring force of the coil spring from the intermediate state.

5. The inserting connector as claimed in claim 3, wherein the coil spring is in an expanded state or a compressed state in the case of the intermediate state; and the control plug terminal is retracted in the inserting direction via the control plug terminal link by a restoring force of the coil spring from the intermediate state.

6. The inserting connector as claimed in claim 1, further comprising:

a lock terminal configured to project in a direction perpendicular to the inserting direction, corresponding to the extension and retraction in the inserting direction of the control plug terminal;

wherein the lock terminal projects in the direction perpendicular to the inserting direction by extending the plug terminal in the inserting direction;

the receiving connector includes a concave part having a configuration corresponding to the projected lock terminal; and by extending the control plug terminal in a state where the inserting connector and the receiving connector are engaged with each other, the lock terminal is engaged into the concave part of the receiving connector in the direction perpendicular to the inserting direction, so that an engaging state of the inserting connector and the receiving connector is maintained.

7. The inserting connector as claimed in claim 1, further comprising:

a ground plug terminal;

wherein the receiving connector includes a ground jack terminal corresponding to the ground plug terminal; and the ground plug terminal and the ground jack terminal are engaged with each other in the engaging state where the inserting connector and the receiving connector are engaged with each other.

8. The inserting connector as claimed in claim 1, wherein the electric power supplied from the electric power source is direct current.

9. The inserting connector as claimed in claim 1, wherein a voltage of the electric power supplied from the electric power source is higher than 48 V.

10. A receiving connector connected to an inserting connector, the inserting connector being configured to electrically connect an electric power source and an electric apparatus receiving an electric power supply from the electric power source, the inserting connector being connected to the electric apparatus, the inserting connector including two electric power plug terminals made of a conductor, the conductor being configured to receive the electric power supply; and a control plug terminal configured to be extended and retracted in an inserting direction;

the receiving connector being connected to the electric power source, the receiving connector including:

two electric power jack terminals corresponding to the electric power plug terminals; and a control jack terminal corresponding to the control plug terminal;

wherein the control jack terminal includes two control switches connected to the two electric power jack terminals;

the electric power source is configured to supply electric power from the electric power jack terminals via the two control switches; and contacts of the two control switches are connected by extending the control plug terminal in the control jack terminal in the inserting direction in a state where two electric power plug terminals and the two electric power jack terminals are engaged with each other, so that the electric power is supplied to the electronic apparatus.

11. The receiving connector as claimed in claim 10, wherein the control switch is a metal plate spring switch.

12. The receiving connector as claimed in claim 11, wherein, in the receiving connector, an insulation spring is provided between the two control switches and the control plug terminal; and the insulation spring is bent by inserting the control plug terminal in the inserting direction so that the contacts of the control switches are connected via the insulation spring.

13. The receiving connector as claimed in claim 10,
wherein a permanent magnet is provided in the vicinity of the contact of each of the control switches; and
the permanent magnet is configured to take out arcing generated at the time when the contact of the corresponding control switch is cut to an outside, so that the electric power supply from the electric power source is cut.

14. The receiving connector as claimed in claim 10,
wherein the inserting connector further includes a ground plug terminal;
the receiving connector includes a ground jack terminal corresponding to the ground plug terminal; and
the ground plug terminal and the ground jack terminal are engaged with each other in the engaging state where the inserting connector and the receiving connector are engaged with each other.

15. The receiving connector as claimed in claim 10,
wherein the electric power supplied from the electric power source is direct current.

16. The receiving connector as claimed in claim 10,
wherein a voltage of the electric power supplied from the electric power source is higher than 48 V.

17. A connector unit configured to electrically connect an electric power source and an electric apparatus receiving an electric power supply from the electric power source, the connector unit comprising:
an inserting connector connected to the electronic apparatus; and
a receiving connector connected to the electric power source;
wherein the inserting connector includes
two electric power plug terminals made of a conductor, the conductor being configured to receive the electric power supply; and
a control plug terminal configured to be extended and retracted in an inserting direction;
the receiving connector includes
two electric power jack terminals corresponding to the electric power plug terminals; and
a control jack terminal corresponding to the control plug terminal;
the control jack terminal includes two control switches connected to the two electric power jack terminals;
the electric power source is configured to supply electric power from the electric power jack terminals via the two control switches; and
contacts of the two control switches are connected by extending the control plug terminal in the control jack terminal in the inserting direction in a state where two electric power plug terminals and the two electric power jack terminals are engaged with each other, so that the electric power is supplied to the electronic apparatus.

18. The connector unit as claimed in claim 17,
wherein the control switch is a metal plate spring switch.

19. The connector unit as claimed in claim 17,
wherein, in the receiving connector, an insulation spring is provided between the two control switches and the control plug terminal; and
the insulation spring is bent by inserting the control plug terminal in the inserting direction so that the contacts of the control switches are connected via the insulation spring.

20. The connector unit as claimed in claim 17,
wherein a permanent magnet is provided in the vicinity of the contact of each of the control switches; and
the permanent magnet is configured to take out arcing generated at the time when the contact of the corresponding control switch is cut to an outside, so that the electric power supply from the electric power source is cut.

21. The connector unit as claimed in claim 17,
wherein extension and retraction in the inserting direction of the control plug terminal is performed by a slide switch or a pushing button switch.

22. The connector unit as claimed in claim 17,
wherein the inserting connector further includes
a slide switch configured to perform the extension and retraction in the inserting direction of the control plug terminal via a control plug terminal link; and
an expandable and compressible coil spring;
wherein the inserting connector is in an intermediate state where a moving direction of the slide switch is perpendicular to an expansion and compression direction of the coil spring; and
the coil spring is expanded and compressed by moving the slide switch.

23. The connector unit as claimed in claim 22,
wherein the coil spring is in an expanded state or a compressed state in the case of the intermediate state; and
the control plug terminal is extended in the inserting direction via the control plug terminal link by a restoring force of the coil spring from the intermediate state.

24. The connector unit as claimed in claim 22,
wherein the coil spring is in an expanded state or a compressed state in the case of the intermediate state; and
the control plug terminal is retracted in the inserting direction via the control plug terminal link by a restoring force of the coil spring from the intermediate state.

25. The connector unit as claimed in claim 17,
wherein the inserting connector further includes a lock terminal configured to project in a direction perpendicular to the inserting direction, corresponding to the extension and retraction in the inserting direction of the control plug terminal;
the lock terminal projects in the direction perpendicular to the inserting direction by extending the plug terminal in the inserting direction;
the receiving connector includes a concave part having a configuration corresponding to the projected lock terminal; and
by extending the control plug terminal in a state where the inserting connector and the receiving connector are engaged with each other, the lock terminal is engaged into the concave part of the receiving connector in the direction perpendicular to the inserting direction, so that an engaging state of the inserting connector and the receiving connector is maintained.

26. The connector unit as claimed in claim 17,
wherein the inserting connector further includes a ground plug terminal;
the receiving connector includes a ground jack terminal corresponding to the ground plug terminal; and
the ground plug terminal and the ground jack terminal are engaged with each other in the engaging state where the inserting connector and the receiving connector are engaged with each other.

27. The connector unit as claimed in claim 17,
wherein the electric power supplied from the electric power source is direct current.

28. The connector unit as claimed in claim 17,
wherein a voltage of the electric power supplied from the electric power source is higher than 48 V.

* * * * *